US008246557B2

(12) United States Patent
Huang et al.

(10) Patent No.: US 8,246,557 B2
(45) Date of Patent: Aug. 21, 2012

(54) HEALTH MAT AND HEALTH BED WITH THE HEALTH MAT

(76) Inventors: Diehsu Huang, Kaohsiung (TW); Haowen Huang, Kaohsiung (TW); Haozhong Huang, Kaohsiung (TW)

( * ) Notice: Subject to any disclaimer, the term of this patent is extended or adjusted under 35 U.S.C. 154(b) by 1062 days.

(21) Appl. No.: 12/227,389

(22) PCT Filed: Dec. 29, 2006

(86) PCT No.: PCT/CN2006/003656

§ 371 (c)(1),
(2), (4) Date: Jun. 27, 2008

(87) PCT Pub. No.: WO2007/076697

PCT Pub. Date: Jul. 12, 2007

(65) Prior Publication Data

US 2010/0222724 A1 Sep. 2, 2010

(30) Foreign Application Priority Data

Dec. 31, 2005 (CN) ..... 2005 1 0135471

(51) Int. Cl.
*A61H 15/00* (2006.01)
*A61G 7/008* (2006.01)

(52) U.S. Cl. ..... 601/98; 601/103; 601/115; 5/607; 5/612; 5/618

(58) Field of Classification Search ..... 601/2, 24, 601/26, 84, 97, 98, 101, 102, 103, 107, 108, 601/111, 115, 116, 134; 5/607, 608, 609, 5/610, 611, 612, 613, 617, 618, 915, 933, 5/934

See application file for complete search history.

(56) References Cited

U.S. PATENT DOCUMENTS 3,799,154 A * 3/1974 Knop ..... 601/57
5,233,712 A * 8/1993 Jurus et al. ..... 601/26
5,708,996 A * 1/1998 Marenco ..... 5/613
6,360,386 B1 * 3/2002 Chuang ..... 5/613
6,799,342 B1 * 10/2004 Jarmon ..... 5/933

* cited by examiner

*Primary Examiner* — Quang D Thanh
(74) *Attorney, Agent, or Firm* — Leong C. Lei

(57) ABSTRACT

A health mat (2) and a health bed (10) with the health mat (2) are provided. The health mat (2) includes a fixed bar unit (3), a movable bar unit (4) that can move relatively to the fixed bar unit (3), and a mat body unit (5) that is on the movable bar unit (4) and can move with it. The reciprocation of the movable bar unit (4) makes the mat body unit (5) move and makes the mat body unit (5) do reciprocative movement.

18 Claims, 23 Drawing Sheets

HEALTH MAT AND HEALTH BED WITH THE HEALTH MAT

BACKGROUND OF THE INVENTION

1. Technical Field of the Invention

The present invention relates to a mattress and a bed, and in particular to a health mat that serves as a seat mat or a bed mat, and a health bed to which the health mat is applicable.

2. Description of the Prior Art

For those long lying on beds, such as vegetables, stroke patients, patients having local or full paralysis of limbs, the aged who are not easy for movement, since they are not able to independently move their limbs, the portions of their bodies that are in constant contact with the mattresses are easy to subject to excessive depression due to long lying on the beds, eventually leading to poor blood circulation and causing bedsores. Thus, the attending persons have to frequently turn the patient's body over and carry out massage for the patient in order to release the depression and improve blood circulation and flowing. However, for the attending persons, including nurses and the family members, it is a heavy physical load job to turn the patient's body over and to massage the patient.

To release the depression for avoiding the occurrence of bedsores, an air mattress bed is available, as shown in FIGS. 1 and 2, in which a publicly known air mattress 1 is illustrated. Referring to FIGS. 1 and 2, the air mattress 1 is positioned on a bed frame 11 to provide an air mattress bed, which includes a plurality of first inflatable members 12, a plurality of second inflatable members 13, and an enclosure 14 covering the first and second inflatable members 12, 13. The first inflatable members 12 and the second inflatable members 13 are arranged to alternate each other and are connected to an inflator (not shown in the drawing). When the inflator fills air into the first inflatable members 12, the first inflatable members 12 are inflated, and at this moment, a body lying on the air mattress 1 induces depressions on the first inflatable members 12 (as shown in FIG. 1). To switch the depression locations of the body, air is introduced into the second inflatable members 13 and at the same time the air inside the first inflatable members 12 is released, whereby the depression locations where the air mattress 1 acts on the body are changed (as shown in FIG. 2). As such, the first inflatable members 12 and the second inflatable members 13 are alternately charged and the depression locations on the body of a user lying on the air mattress 1 are switched, thereby avoiding the situation that the same location of the body is long subjected to depression applied thereto and thus realizing the effect of avoiding the occurrence of bedsores.

However, since the operation of the inflatable members 12, 13 of the air mattress only provides the effect of switching depression locations that are concerned by the western medicine and is not able to realize the kneading effect of the Chinese medicine. Thus, it is not possible to improve the blood circulation for the users, so that the effectiveness that it can provide for a user is only of a limited extent and no effect of relaxing the tensioned muscles of the healthy persons that are caused by stretching of daily living. As a result, the effect that the known device can provide to the users is very limited.

Thus, it is an issue extremely requiring improvement by the industry to create a mat that provides powerful effectiveness and will be widely acceptable by the market to realize both relaxation of muscles and maintaining excellent condition of skin and at the same time allowing the long term users or the aged to relax their muscles and enjoy improved living quality and maintain good conditions and reduce pain.

SUMMARY OF THE INVENTION

An objective of the present invention is to provide a health mat that is provided for all users, and that provides the effect of improving blood circulation and relaxing the pressures of the back muscles to remove tiredness for the healthy persons and that provides the effect of switching depression locations and ensuring ventilation, plus the effect of kneading and massaging to thereby maintain excellent condition of skin and avoid the occurrence of harmful consequence of paralysis for users who long lie or sit thereon to realize improvement of blood circulation.

In accordance with the above object, a health mat in accordance with the present invention is positionable on a support rack, such as chair, a chair frame, a bed or a bed frame. The health mat comprises a fixed bar unit, a movable bar unit positioned on the fixed bar unit, and a mat body unit.

Wherein the fixed bar unit comprises two fixed bar sets, which are arranged in a spaced manner and are positionable on a bed frame.

The movable bar unit comprises two movable bar sets respectively corresponding to the fixed bar sets and a massage power unit that moves the movable bar sets to have each movable bar set movable with respect to each fixed bar set.

The mat body unit is arranged between the movable bar sets and movable in unison therewith. The mat body unit comprises a plurality of cross bars that are of a spaced and parallel arrangement.

The massage power unit of the movable bar unit, when activated, reciprocally moves each movable bar set, to drive reciprocal movement of each cross bar of the mat body unit for carrying out kneading operation and switching depression locations for a user in a sitting or lying posture.

Another objective of the present invention is to a health bed comprising the above described health mat.

In accordance with the objective of the present invention, the health bed of the present invention comprises a bed frame unit and three of said health mat. The health mats are positioned on the bed frame unit in a juxtaposed manner and adjacent ones of the health mats are pivotally coupled to each other.

As such, for a user lying on the health bed in accordance with the present invention, besides realizing functions of switching depression locations and kneading operation, operation of the health mat also has a function of turning body over for thereby relaxing the discomfort and stretching and tiredness of the body and at the same time maintaining an excellent condition of the skin to avoid the occurrence of harmful consequence, such as paralysis.

BRIEF DESCRIPTION OF THE DRAWINGS

FIG. 10-1 is another local exploded view of the second embodiment, illustrating another way of coupling between a mat block and a cross bar of the mat body unit;

FIG. 11-1 is a local exploded view of the second embodiment, illustrating yet a further way of coupling between a mat block and a cross bar of the mat body unit;

And, in the drawings:

Figure 1:
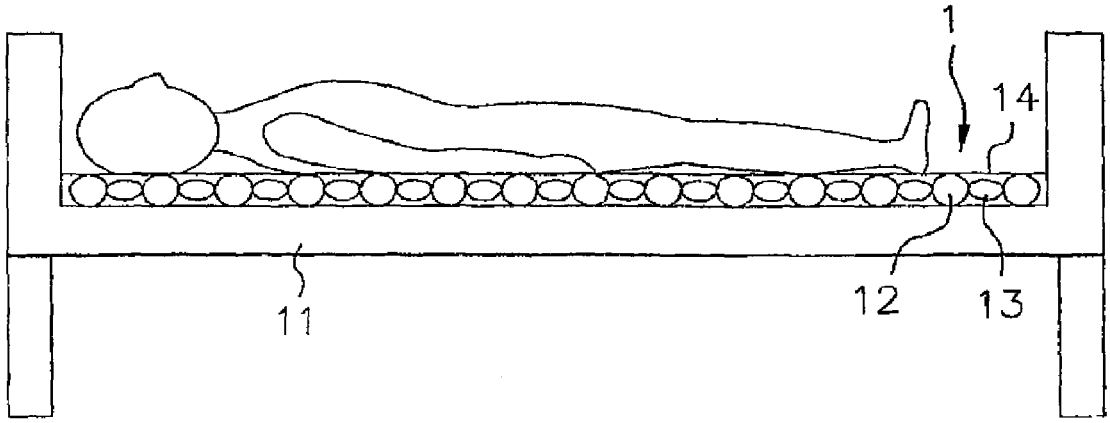
FIG. 1 is a cross-sectional view of a known health mat, illustrating relationship among various component of the health mat.

10: health bed, 2: health mat, 20: support rack, 3: fixed bar unit, 31: fixed bar set, 311: first fixed bar, 312: second fixed bar, 313: third fixed bar, 314: fourth fixed bar, 315: resilient plate, movable bar unit 4: movable bar unit, 41: movable bar set, 411: first movable bar, 412: second movable bar, 413: third movable bar, 414: fourth movable bar, 415: roller, 42: massage power unit, 421: motor, 422: gear box, 423: extendable member, 5: mat body unit, 51: interconnection bar, 52: mat block, 520: passage channel, 521: slot, 522: ventilation channel, 53: resilient member, 531: coupling block, 532: projection, 54: cross bar, 541: fitting hole, 55: elevation bar, 551 recess, 56: elevation power unit, 561: motor, 562: cam, 6: flapping unit, 61: flapper, 611; flapping head, 612: connection rod, 613: resilient member, 62: flapping power unit, 621: motor, 622: transmission member, 7: covering unit, 71: covering envelop, 72: ventilation opening, 8: bed frame unit, 81: bed frame, 811: handrail set; 82: lifting member, 83: front lifting power unit, 831: motor, 832: gear train, 833: extension/contraction member, 84: rear lifting power unit, 841: motor, 842: gear train, 843: extension/contraction member, 85: left lifting power unit, 851: motor, 852: extension/contraction member, 86: right lifting power unit, 861: motor, 862: extension/contraction member, 87: side lifting power unit, 9: support bar.

DETAILED DESCRIPTION OF THE PREFERRED EMBODIMENTS

The above and other technique contents, features, and advantages of the present invention will be apparent with the following detailed description with respect to several preferred embodiments with reference to the attached drawings. Before the detailed description of the present invention is given, it is noted that in the following description, similar components are designated with the same reference numerals.

Embodiment 1

Figure 3:
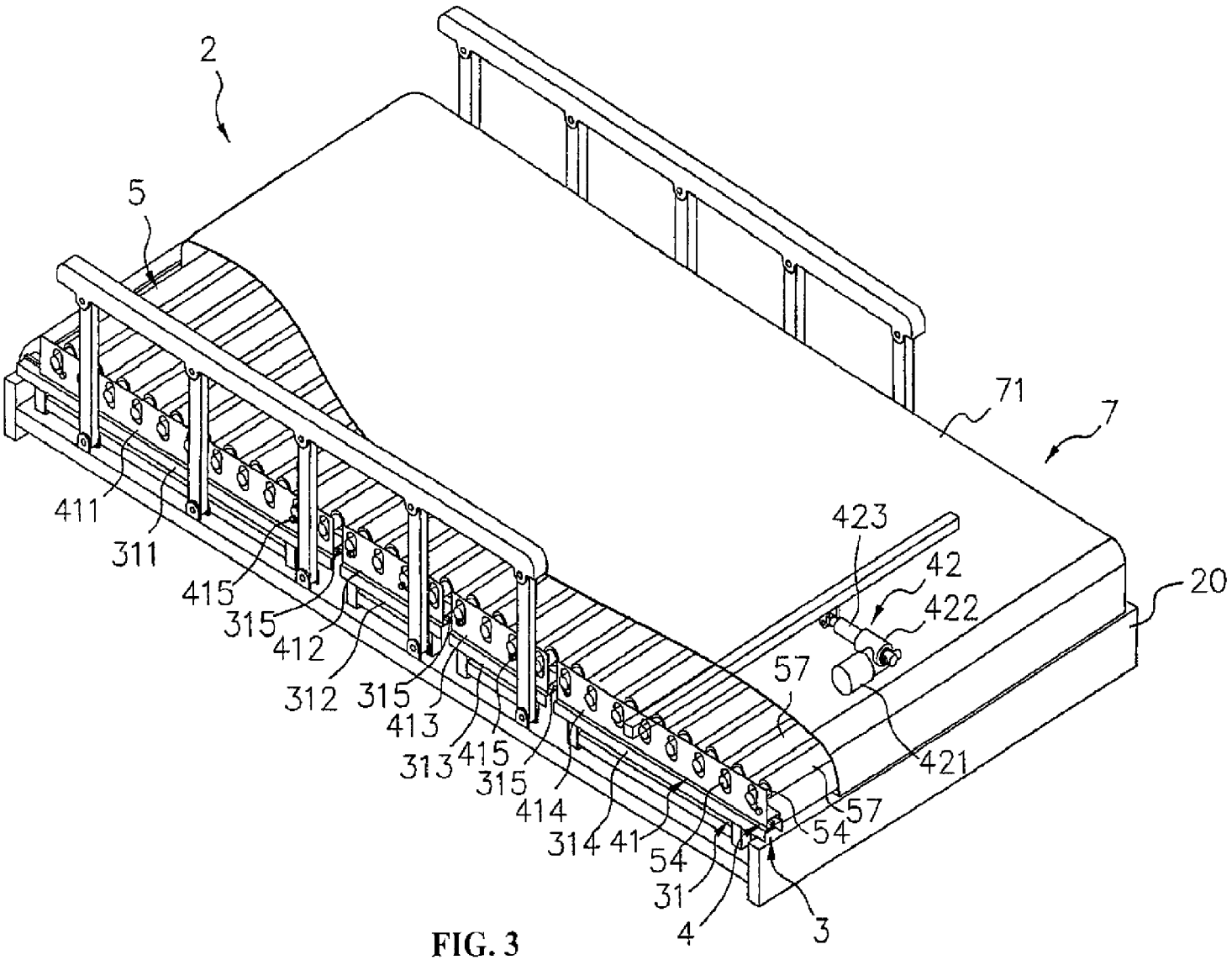
FIG. 3 is a perspective view of a first embodiment of the present invention, illustrating major structures of a health mat of the present invention and the relative positions therebetween, the embodiment being positioned on a support rack, in which a covering unit is broken.

As shown in FIG. 3, a health mat 2 in accordance with a first preferred embodiment of the present invention is given, which is supported on a support rack 20. The health mat 2 comprises a fixed bar unit 3, a movable bar unit 4 arranged on the fixed bar unit 3, a mat body unit 5 arranged between the movable bar unit 4, and a covering unit 7.

In the present embodiment, the support rack 20 is a bed frame. However, the support rack 20 can also be a chair frame or other frames that can stand and is not limited to the description of the present embodiment.

The fixed bar unit 3 comprises two fixed bar sets 31, which are arranged in a spaced manner and are positionable on the health mat 20. Each fixed bar set 31 is comprised of a first fixed bar 311, a second fixed bar 312, a third fixed bar 313, and a fourth fixed bar 314 that are sequentially arranged in a spaced manner and a plurality of resilient plates 315 that is respectively connected between the first and second fixed bars 311, 312, between the second and third fixed bars 312, 313, and between the third and fourth fixed bars 313, 314. The resilient plates 315 can be replaced with other pivotal connection, such as multiple-articulation pivotal connection or single-articulation pivotal connection, which may render similar articulation effect. Omission of one of the fixed bar sets 31 may still provide the same effect. Thus, the scope of the present invention is not constrained by the number of the fixed bar sets 31.

The movable bar unit 4 comprises two movable bar sets 41, which correspond to and are arranged on the fixed bar sets 31, and a massage power unit 42 that moves the movable bar sets 41. Each movable bar set 41 is comprised of a first movable bar 411, a second movable bar 412, a third movable bar 413, and a fourth movable bar 414, which are arranged in a spaced manner. The first, second, third, and fourth movable bars 411-414 are each provided with a plurality of rollers 415 to allow each movable bar set 41 to be movable with respect to each fixed bar set 31. In the present embodiment, each roller 415 is respectively arranged at two opposite ends of the first, second, third, and fourth movable bars 411-414. It is apparent that several additional rollers 415 can be further included as desired to enhance the supporting force. Omission of one of the movable bar sets 41 may still provide the same effect. Thus, the scope of the present invention is not constrained by the number of the movable bar sets 41.

The massage power unit 42 can reciprocally move each movable bar set 41, making each roller 415 rolling on each fixed bar set 31. In the present embodiment, as shown in FIG. 3, the massage power unit 42 drives the fourth movable bar 414. The massage power unit 42 comprises a motor 421 that is electrically operated, a gear box 422 that is driven by the motor 421, and an extendable member 423 that is driven by the gear box 422 to extend or contract. However, the massage power unit 42 can alternatively achieve the operation of driving each movable bar set 41 by means of a hydraulic cylinder and associated component. The operation of driving is not construed as the sole feature of the present invention and thus does not constrain the scope of the present invention.

Figure 4:
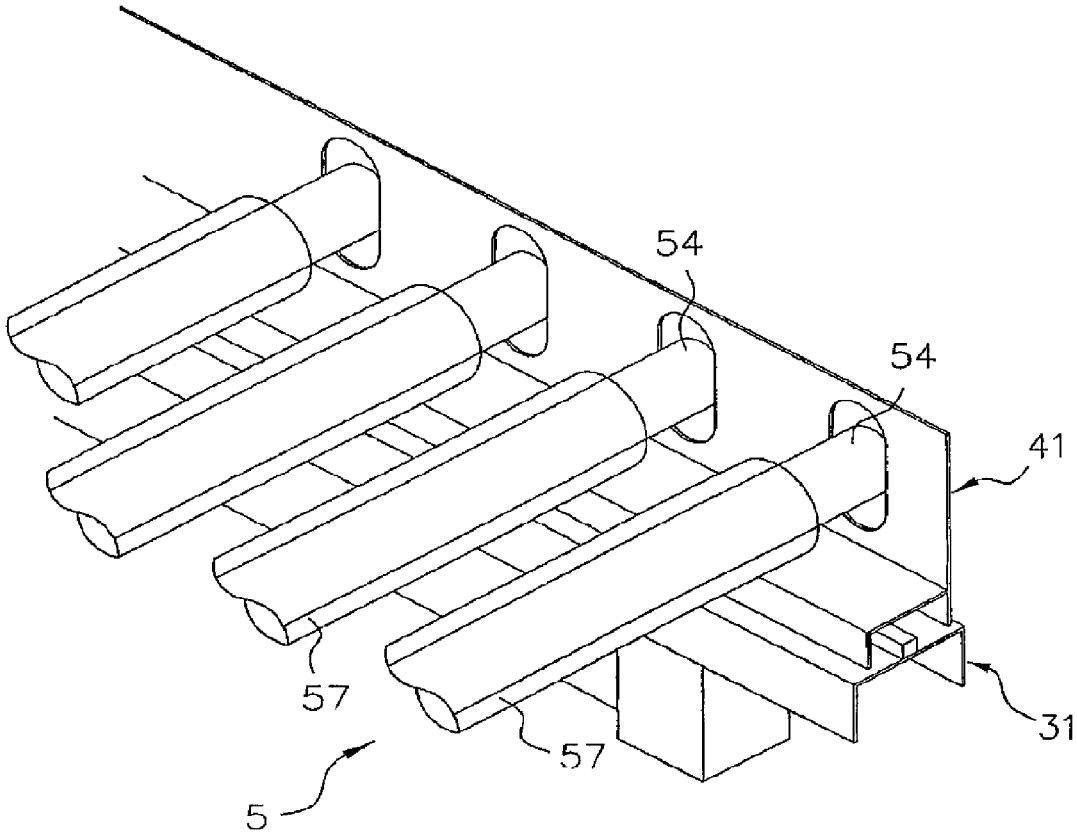
FIG. 4 is a local magnified perspective view of the first embodiment, illustrating each cross bar is fit through the movable bar unit.
Figure 5:
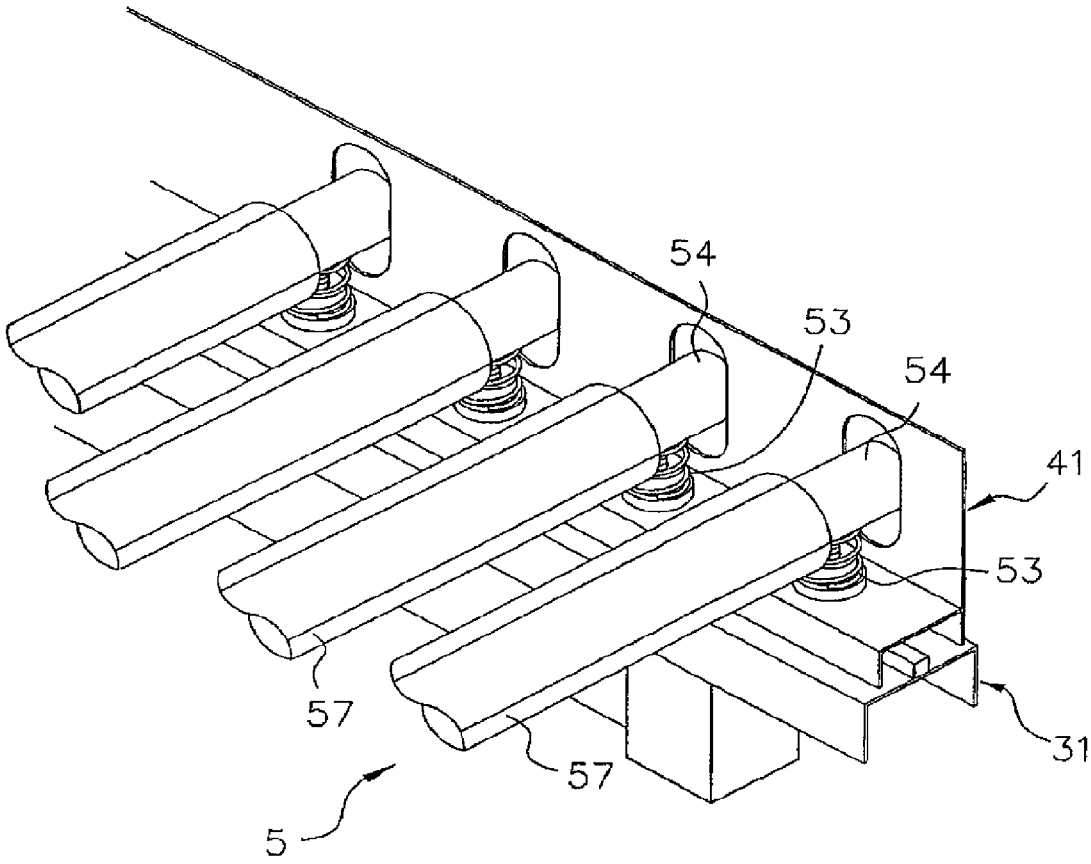
FIG. 5 is another local magnified perspective view of the first embodiment, illustrating a resilient member is selectively provided below each cross bar.
Figure 6:
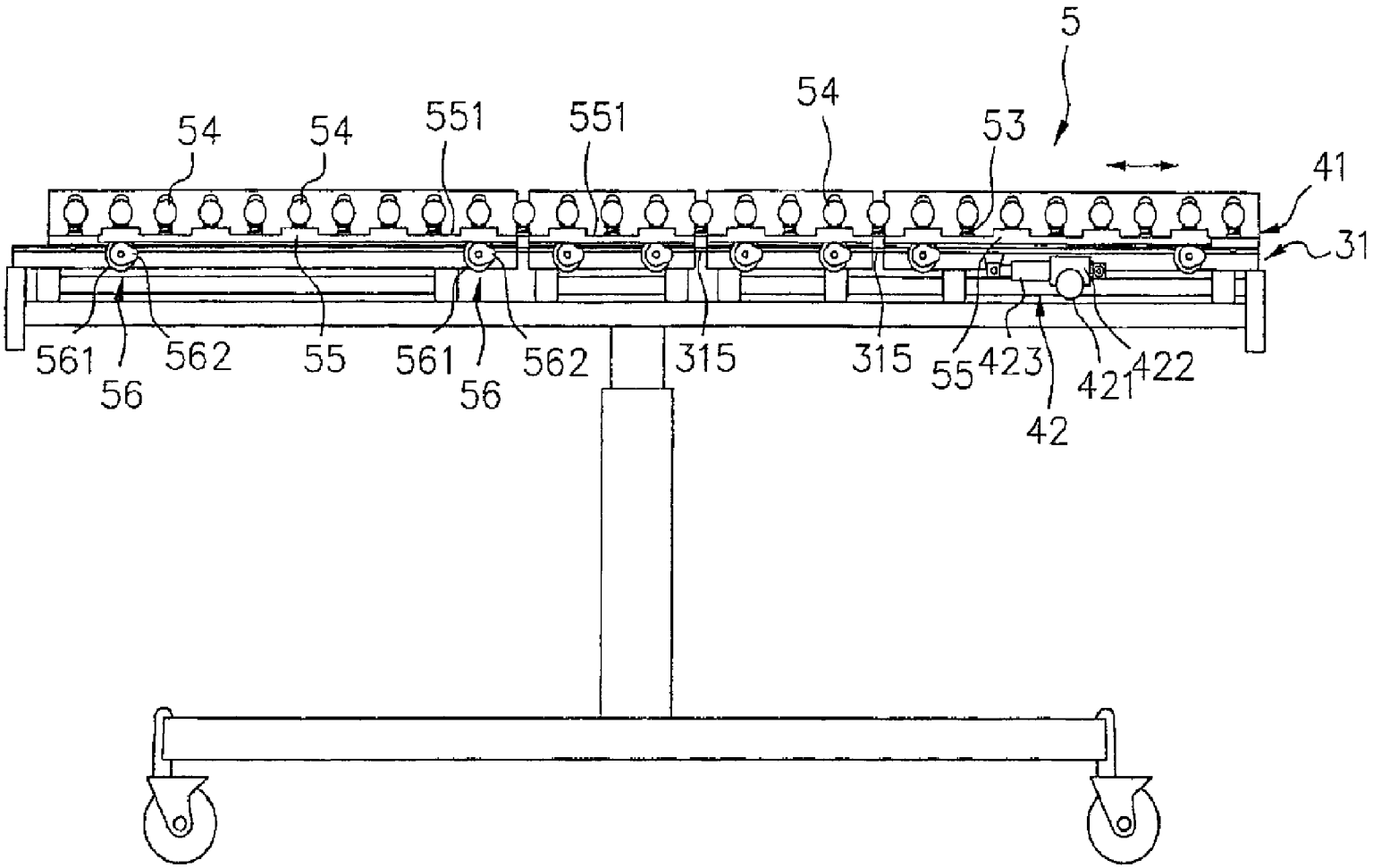
FIG. 6 is a side elevational view of the first embodiment illustrating a condition where an elevation power unit of the mat body unit is not operated.

As shown in FIGS. 4 and 5, together with FIG. 6, the mat body unit 5 is arranged between the two movable bar sets 41 and is movable in unison therewith. The mat body unit 5 is comprised of a plurality of cross bars 54 that are of a spaced and parallel arrangement and further includes an elevation bar 55 that is arranged below a bottom of each cross bar 54, an elevation power unit 56 that moves the elevation bar 55, and a plurality of rotary tubes 57 that are respectively fit over the cross bars 54 and are rotatable. The presence or not of the elevation bars 55 and the rotary tubes 57 is not subjected to any limitation.

The cross bars 54 are fit through the movable bar sets 41 of the movable bar unit 4. In order to realize upward and downward movements of each cross bar 54 with respect to the movable bar set 41 (as shown in FIG. 4), two opposite ends of each cross bar 54 are respectively provided with resilient members 53 (as shown in FIG. 5). Each resilient member 53 functions to automatically adjust the altitude of each cross bar 54 in order to comply with the contour curve of the body of a user for making the user comfortable.

Figure 7:
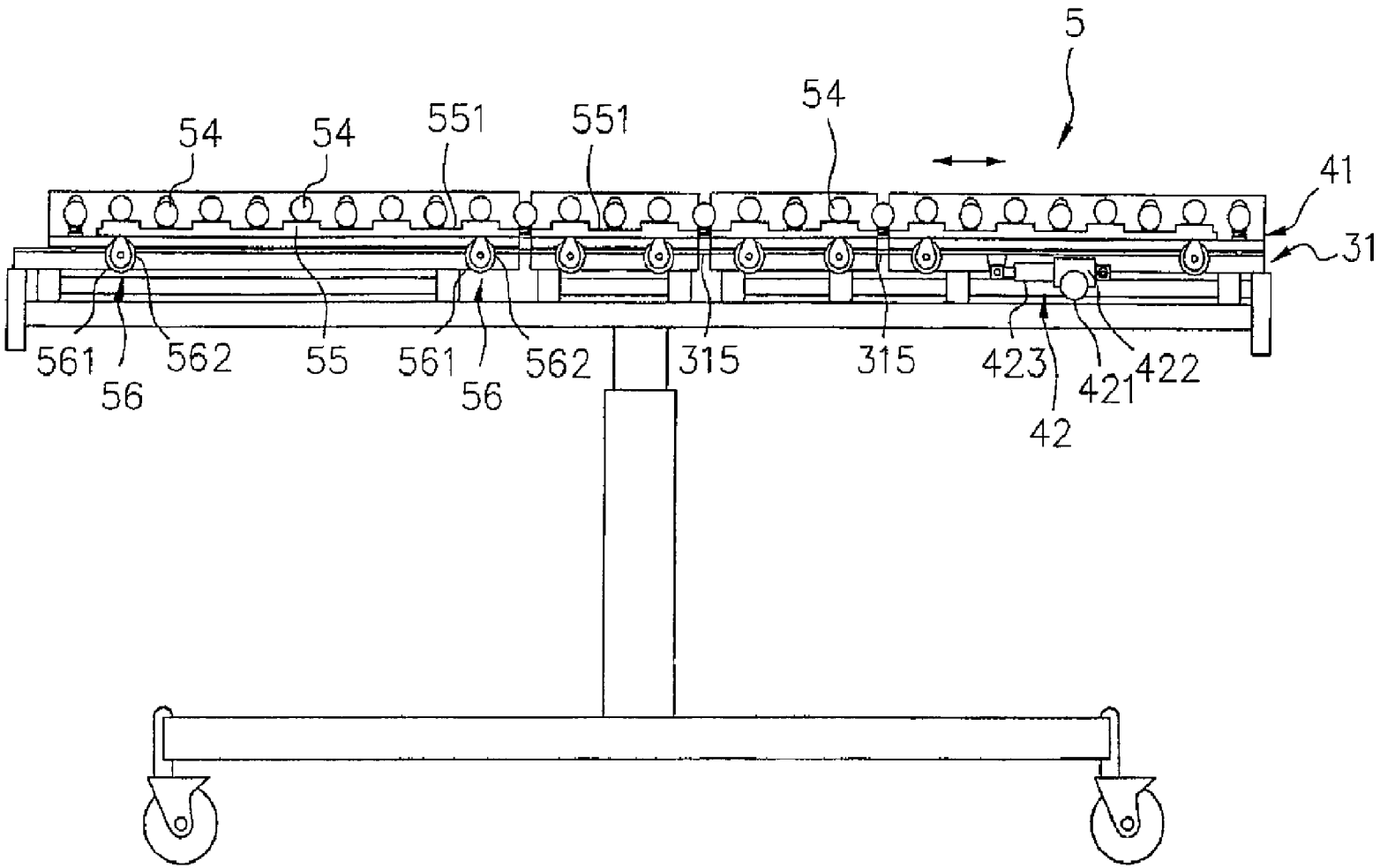
FIG. 7 is a side elevational view of the first embodiment illustrating a condition where the elevation power unit of the mat body unit is put in operation to cause alternate ones of the cross bars to elevate and project beyond other cross bars.

Also referring to FIG. 7, the elevation bars 55 are movable in synchronization with the movable bar sets 41 and forms in a top face thereof a plurality of recesses 551 that is alternately corresponding to the cross bars 54 for receiving the cross bars 54 therein. When the elevation power units 56 moves the elevation bars 55 upward, the cross bars 54 that do not correspond to the recesses 551 are elevated to form an alternately undulated configuration.

In the present embodiment, each cross bar 54 has a circular cross-section and is fit with at least one of the rotary tubes 57, whereby the rotary tubes 57 are rotatable about axes of the corresponding cross bars 54. Apparently, in a practical application, it is not necessary to include the rotary tubes 57 and the resilient members 53, or it is possible to provide the rotary tubes 57 with a design of non-constant or irregular external configuration. Thus, in case the rotary tubes 57 are omitted, the external configuration of the cross bars 54 does not need to be circular and can be other shapes, which also result in the same effect of kneading.

As shown in FIG. 3, the covering unit 7 covers the mat body unit 5 and is comprised of a covering envelop 71 that is made of a cloth material or other soft materials for providing the user with more comfortable feeling of lying and also for easy replacement, as well as preventing the user from direction contact with the mat body unit 5.

Also referring to FIGS. 5 and 6, when the massage power unit 42 of the movable bar unit 4 is activated, each movable bar set 41 is reciprocally moved so as to cause reciprocal movement of the cross bars 54 of the mat body unit 5, thereby performing kneading and switching depression locations for a user in a sitting posture or a lying posture. When the cross bars 54 are provided with the above discussed rotary tubes 57, the rotary tubes 57 are rotated with the movement of each cross bar 54; and further, the rotary tube 57 can be divided into multiple small segments forming spherical shapes to provide the health mat 2 with a function of rolling massaging. Preferably, if the movement of the elevation power units 56 is included, then the kneading effect that facilitates blood circulation can be enhanced.

Embodiment 2

Figure 8:
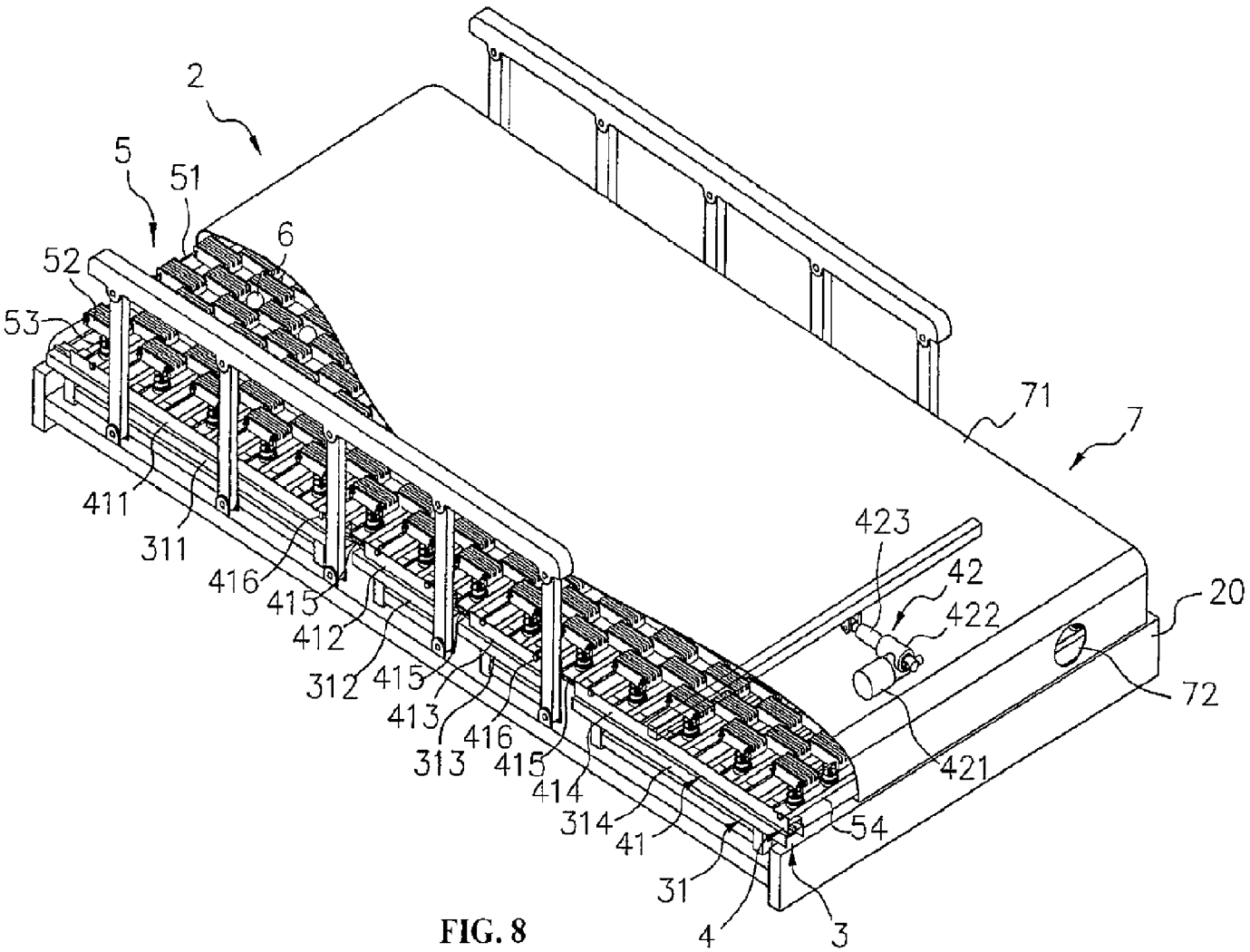
FIG. 8 is a perspective view of a second embodiment of the present invention, illustrating major structures of a health mat and the relative positions therebetween, the health mat being positioned on a support rack, in which a covering unit is broken.
Figure 9:
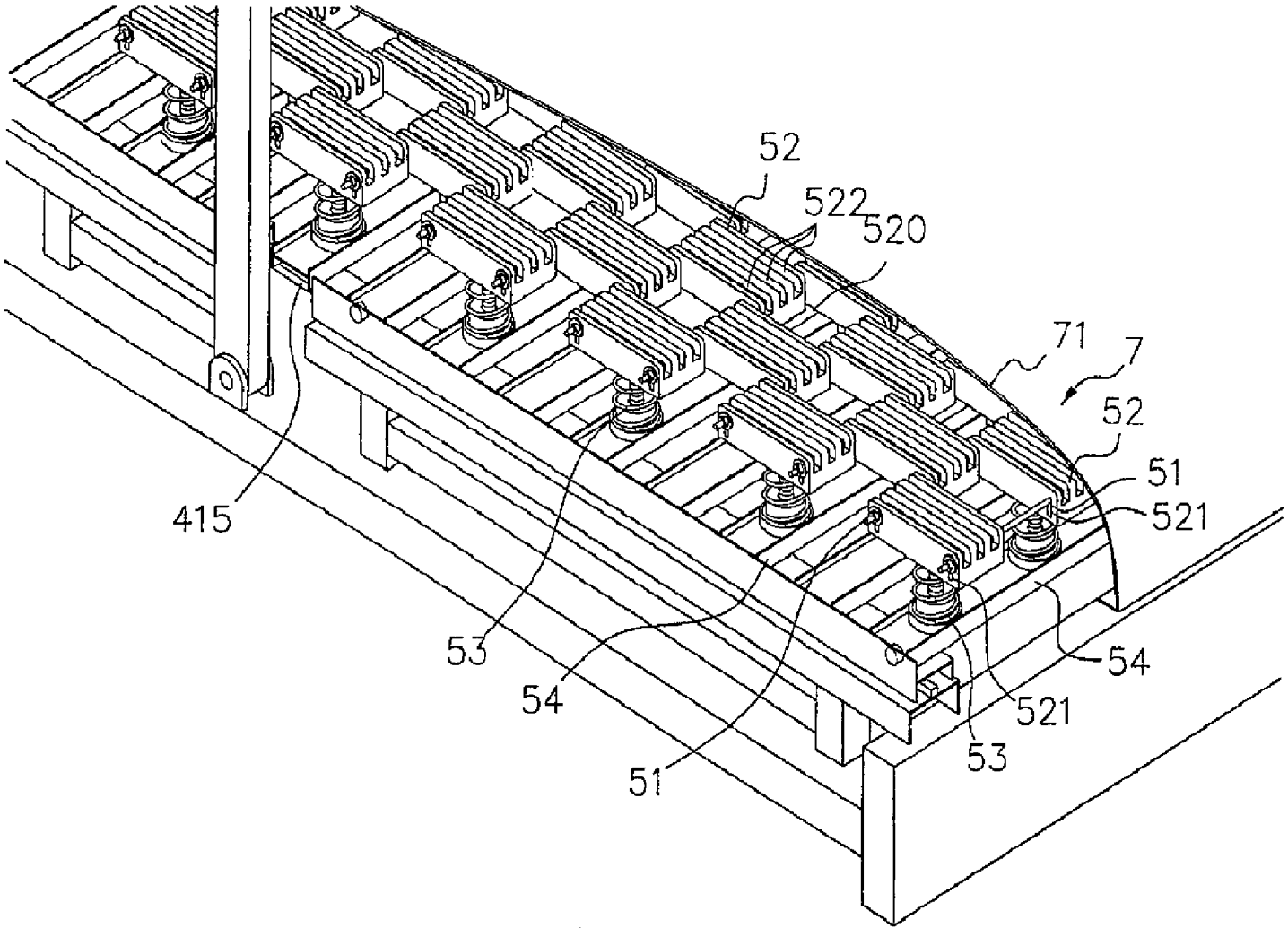
FIG. 9 is a local magnified perspective view of the second embodiment.
Figure 12:
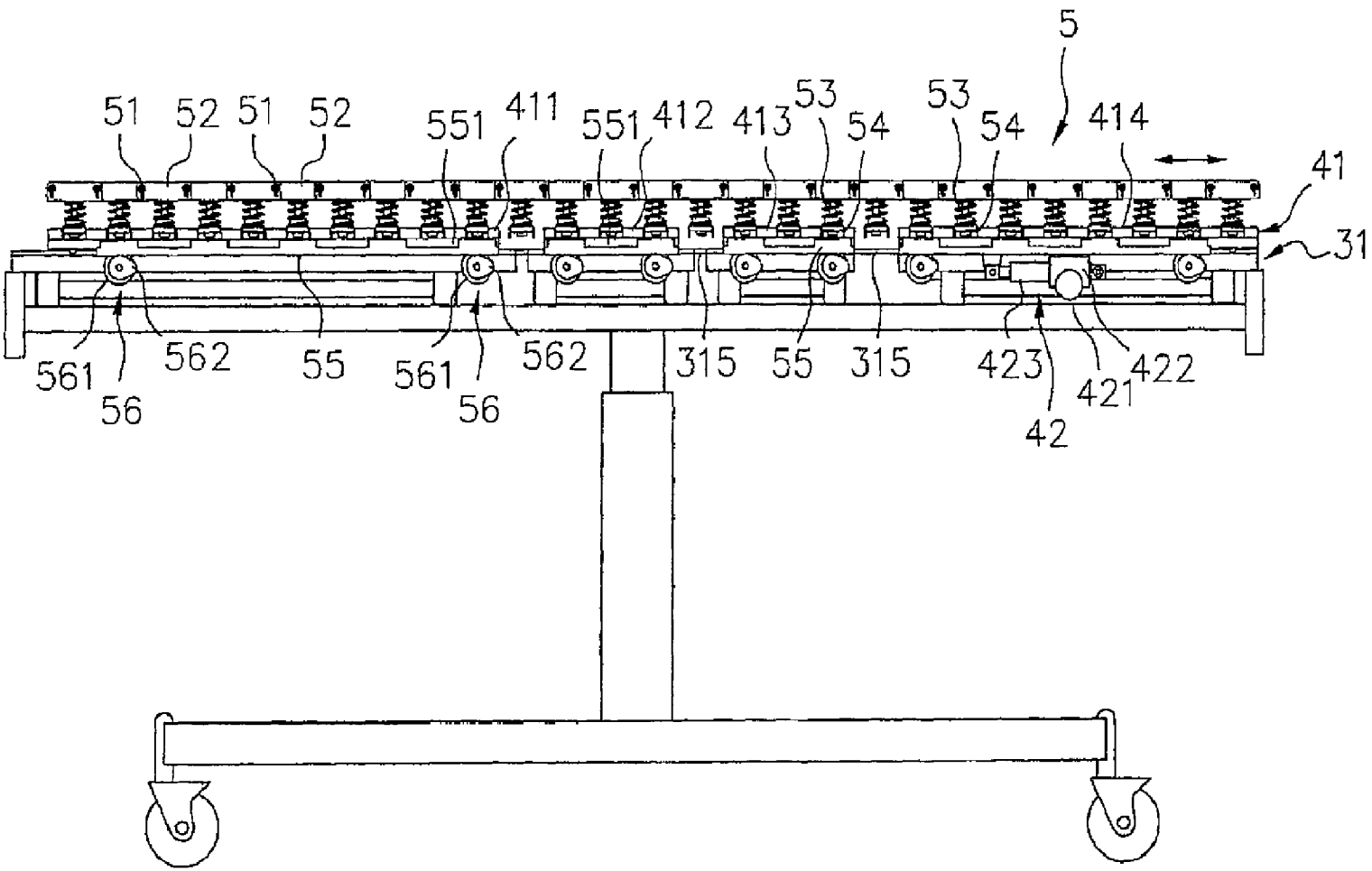
FIG. 12 is a side elevational view, illustrating a condition where an elevation power unit of the mat body unit is not operated.

As shown in FIGS. 8 and 9, together with FIG. 12, a second preferred embodiment of the health mat 2 in accordance with the present invention differs from the first preferred embodiment in that the mat body unit 5 is comprised of a plurality of cross bars 54, a plurality of mat blocks 52, which may further include a plurality of spaced elongate interconnection bars 51, a plurality of mat blocks 52 fit over each interconnection bar 51 and arranged in a spaced manner, a plurality of resilient members 53 arranged between the mat blocks 52 and the cross bars 54, a plurality of elevation bars 55 that is arranged below the bottom of each cross bar 54 and is movable with the cross bar 54, and a plurality of elevation power units 56 that moves the plurality of elevation bars 55 upward and downward. Since the mat body unit 5 is provided with the mat blocks 52, the cross bars 54 do not need to be of a design of circular cross-section and it is not necessary to include the rotary tubes 57 (see FIG. 4). The health mat 2 may further comprise a flapping unit 6 for flapping the back of a user. It is noted from the above description that the interconnection bars 51, the resilient members 53, the elevation bars 55, and the flapping unit 6 can be arranged in accordance with the requirement and the presence thereof is not subjected o any constraint.

Each mat block 52 is arranged in an alternating manner and a passage channel 520 is defined between two adjacent mat blocks 52. Each mat block 52 forms a plurality of slots 521, which are vertically elongated for the extension of the interconnection bars 51, and a plurality of ventilation channels 522 that is formed by recessing a top face thereof, wherein the arrangement of the slots 521 allows each mat block 52 to be independently movable upward and downward.

In the first preferred embodiment, the resilient members 53 are arranged at opposite ends of each cross bar 54, but in the present embodiment, a greater number of resilient members 53 is arranged between the mat blocks 52 and the cross bars 54. Each of the resilient members 53 is a compression spring. Again, when a user lies down on the health mat 2, the position of each mat block 52 can be automatically adjusted by means of each resilient member 53 to comply with the body shape of the user, allowing the user to lie conformably.

The cross bars 54 are set parallel to the interconnection bars 51 and are respectively coupled to the first, second, third, and fourth movable bars 411-414 of the movable bar sets 41 in a one-fixed and the-other-non-fixed manner, wherein the cross bar 54 that are not fixed to the movable bar sets 41 may be instead fixed to the elevation bars 55, but it is not subjected to any constrain regarding whether fixing or not fixing to the elevation bars 55. The one-fixed and the-other-non-fixed arrangement of the cross bars 54 is to allow for alternate elevation thereof. Thus, whatever can realize alternate elevation of the cross bars 54 is considered within the scope of protection provided by the present invention.

Figure 10:
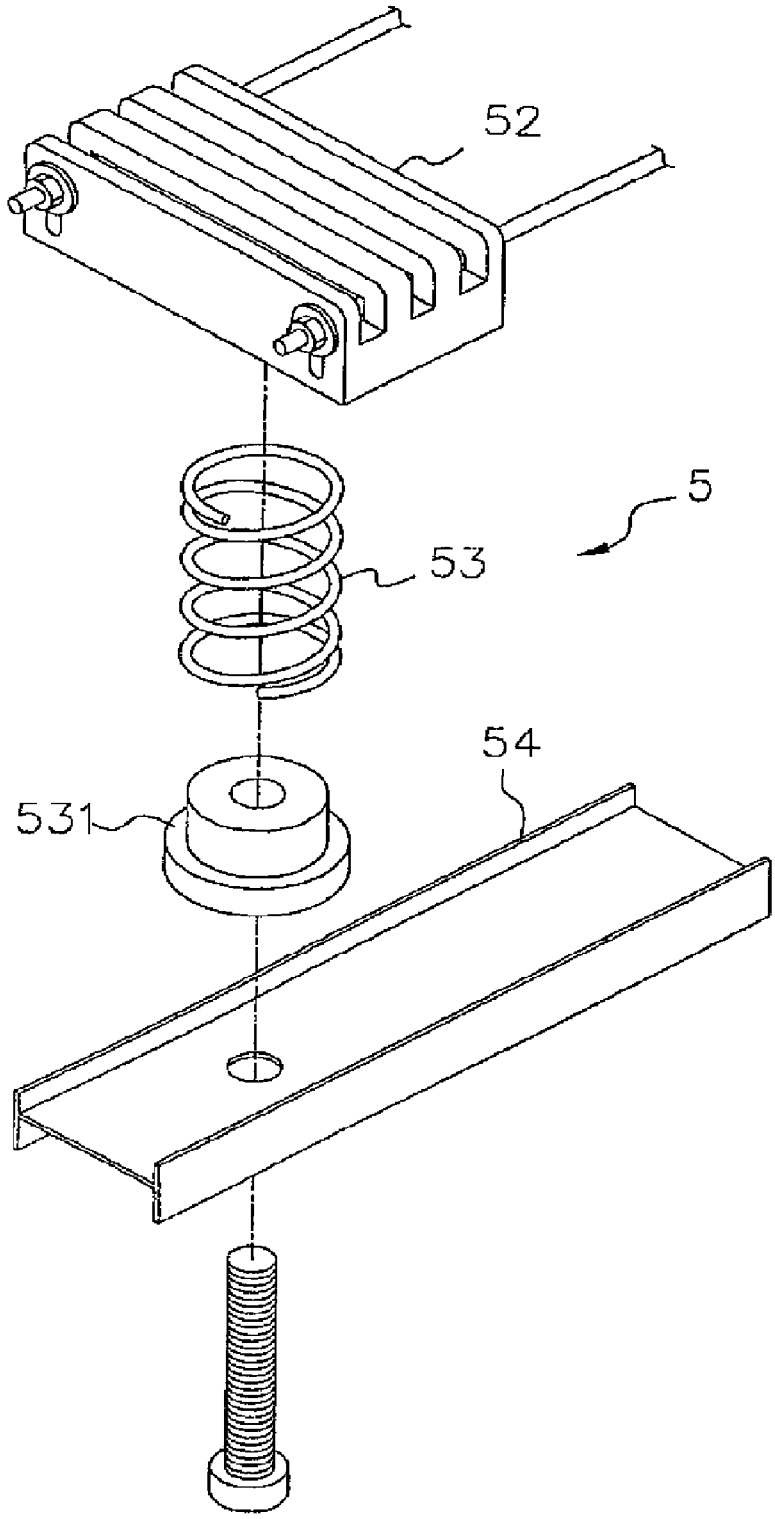
FIG. 10 is a local exploded view of the second embodiment, illustrating a way of coupling between a mat block and a cross bar of the mat body unit.
Figures 1, 10:
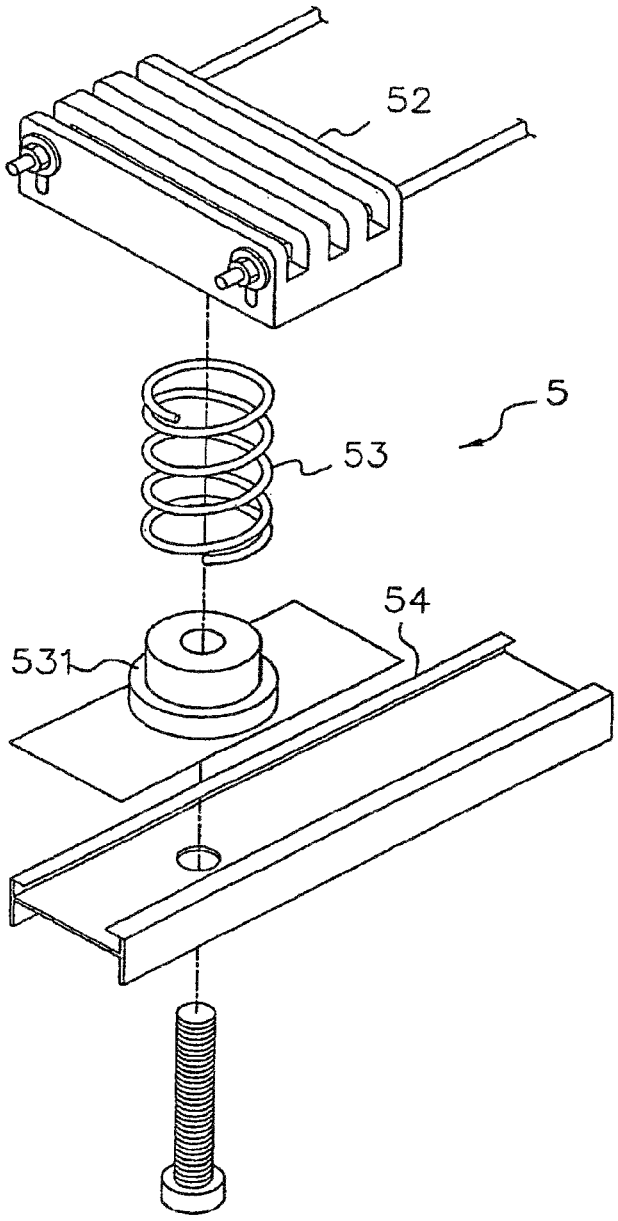

As shown in FIG. 10, since the numbers of the mat blocks 52, the resilient members 53, and the cross bars 54 are great (only one being shown in the drawing), to simplify the assembling operation, each resilient member 53 can be provided, at a bottom thereof, with a coupling block 531. Each coupling block 531 has a bottom diameter that is close to a width of a recess formed in each cross bar 54 for directly fitting to the cross bar 54, or alternatively, each coupling block 531 forms two groves in a bottom thereof for fitting onto each cross bar 54; and each mat block 52, resilient member 53, and coupling block 531 are fixed together by means of a bolt so that each resilient member 53 is compressed, subjecting each mat block 52 a springing force to a certain extent, whereby the whole mat body unit 5 can demonstrate a flat condition (such a condition being illustrated in FIG. 8), which is free of undulation and irregularity that affects the aesthetics.

As shown in FIG. 10-1, another way of fixing the mat block 52, the resilient member 53, and the cross bar 54 is shown, which is different from the fixing realized in FIG. 10 in that each coupling block 531 is additionally provided with a padding plate (not labeled in the drawing) and opposite walls of the recess of the cross bar 54 are provided with flanges, whereby the padding plate can be fit in the recess of the cross bar 54 and the padding plate couples the coupling block 531 to the cross bar 54 to realize simple and efficient assembling/disassembling.

Figure 11:
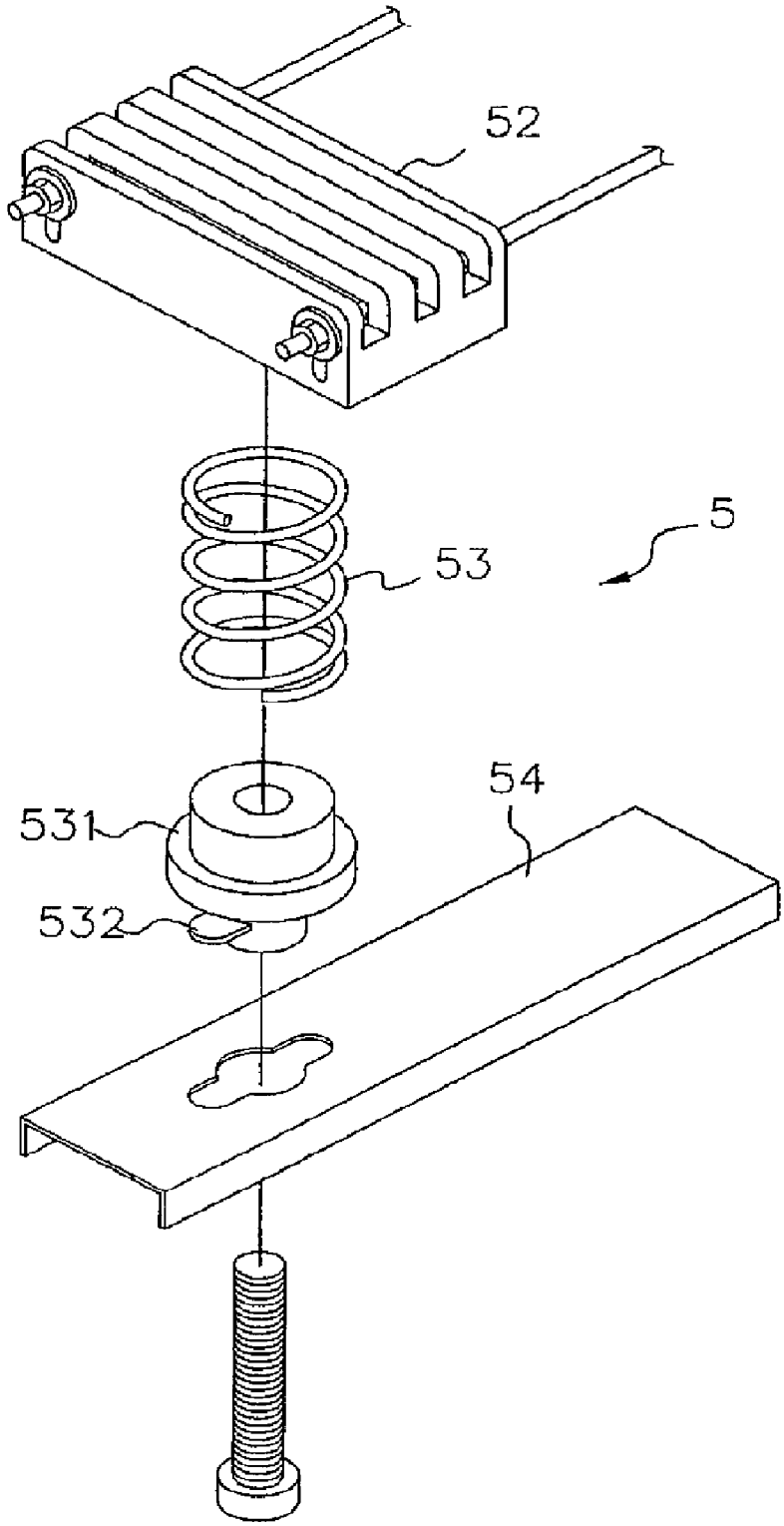
FIG. 11 is a local exploded view of the second embodiment, illustrating a further way of coupling between a mat block and a cross bar of the mat body unit.
Figures 1, 11:
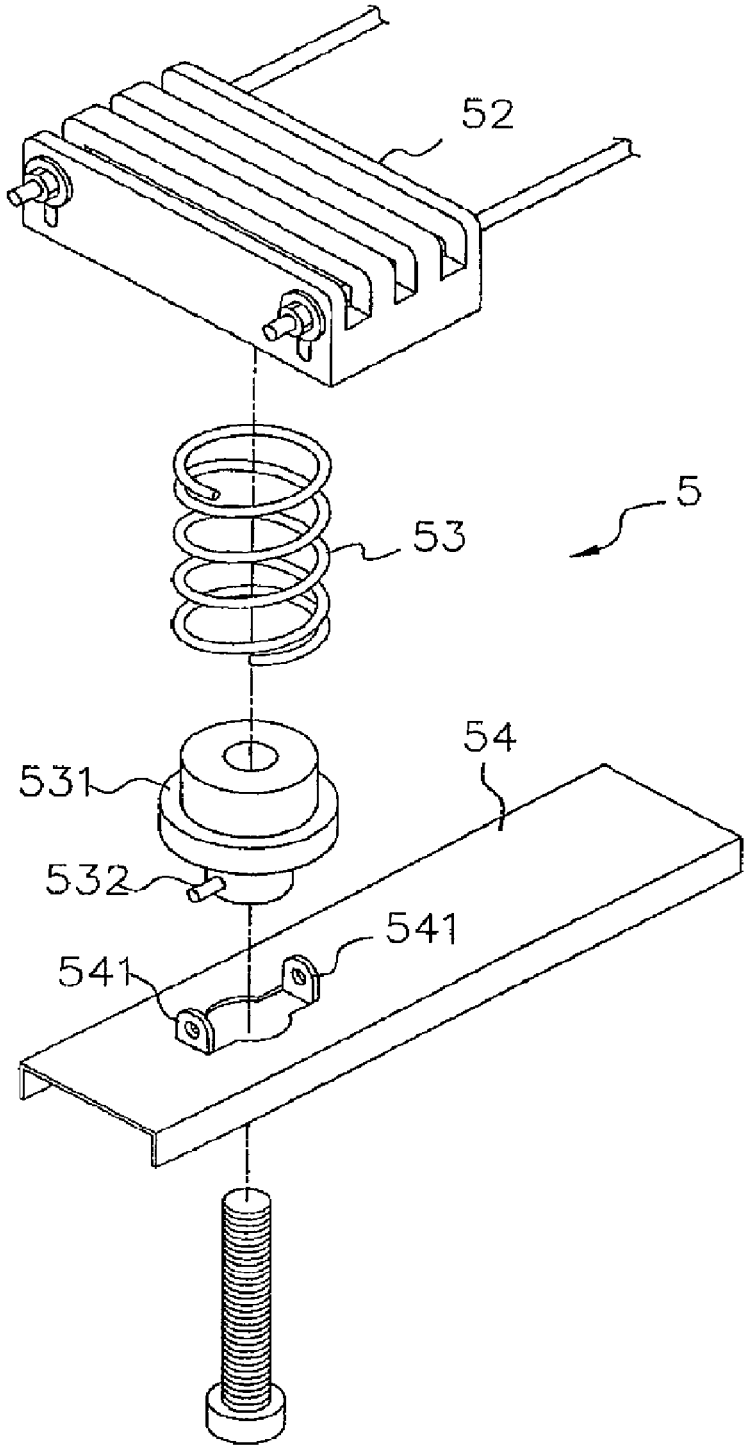

As shown in FIG. 11, a further way of fixing the mat block 52, the resilient member 53, and the cross bar 54 is shown. Each coupling block 531 is provided with two opposite projections 532, which are in the form of a board and can directly fit through the corresponding cross bar 54, followed by being rotated by an angle to thereby fix to the cross bar 54, so that efficient and simple assembling can thus be realized. However, the coupling block 531 can be instead fit to a bottom of the mat block 52, achieving the same result of simplifying the assembling process.

As shown in FIG. 11-1, the two projections 532 of each coupling block 531 are cylindrical and the corresponding cross bar 54 forms fitting holes 541 for the passage of the projections 532 to thereby allow small-extent rocking of the coupling block 531 for better complying with the curve of human body. Regarding the manner of fixing of the mat block 52, the resilient member 53, and the cross bar 54, many variations are available, but this is not the sole feature of the present invention and is thus not construed as a limitation to the scope of the present invention.

Figure 13:
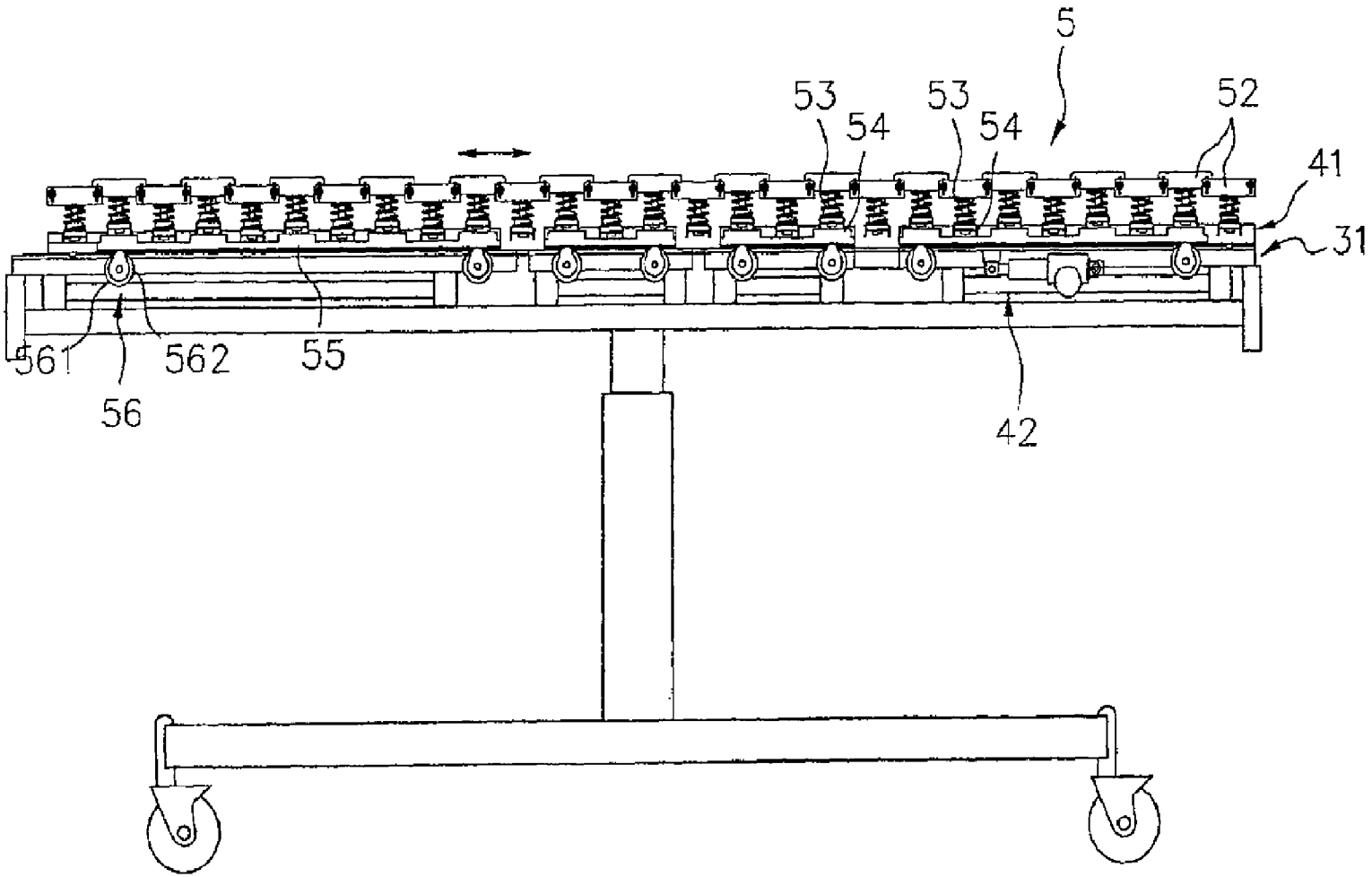
FIG. 13 is a side elevational view, illustrating a condition where the elevation power unit of the mat body unit is put in operation to cause alternate ones of the mat blocks to elevate and project beyond other mat blocks.

As shown in FIGS. 12 and 13, the elevation bars 55 are corresponding to and coupled with the first, second, third, and fourth movable bars 411-414 and are movable in synchronization therewith. The top face of each elevation bar 55 is provided with a plurality of recesses 551 for receiving the cross bars 54.

It is noted that the recesses 551 are set to respectively correspond to the cross bars 54 that are fixed to the movable bar sets 41, while the cross bars 54 that are not fixed to the movable bar sets 41 can be selectively fixed to the elevation bars 55.

By each elevation power unit 56 raising each elevation bar 55 upward, the cross bars 54 that are not fixed to the movable bar sets 41 (or that are fixed to each elevation bar 55) are moved upward, while the cross bars 54 that are fixed to the movable bar sets 41 are received into the recesses 551, making the cross bars 54 or mat blocks 52 of the mat body unit 5 exhibiting an alternately undulated configuration (or one rising while the other falling). In the present embodiment, each elevation power unit 56 is comprised of a motor 561 and a cam 562 that is driven by the motor 561 and is located below the bottom of the elevation bar 55, and the rotation of each cam 562 causes the movement of each elevation bar 55. However, moving the elevation bar 55 upward can be realized with various other ways, which will not be put into detailed discussion. It is undertook by those having ordinary skills in the art that the way of realizing the upward movement is not the sole feature of the present invention and is thus not construed as a limitation to the scope of the present invention.

Figure 14:
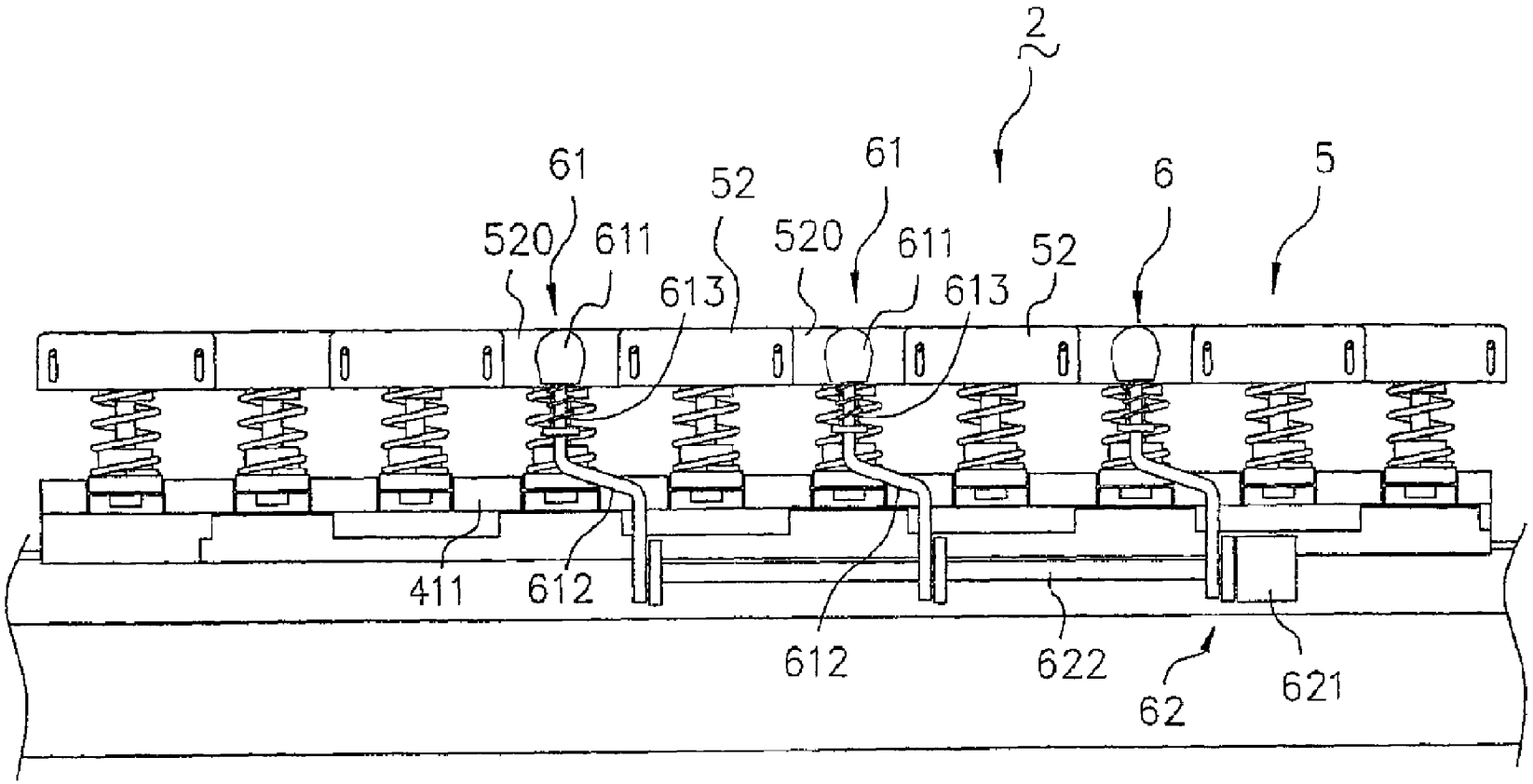
FIG. 14 is a schematic operational view, illustrating a constructed condition of a flapping unit of the second embodiment.
Figure 15:
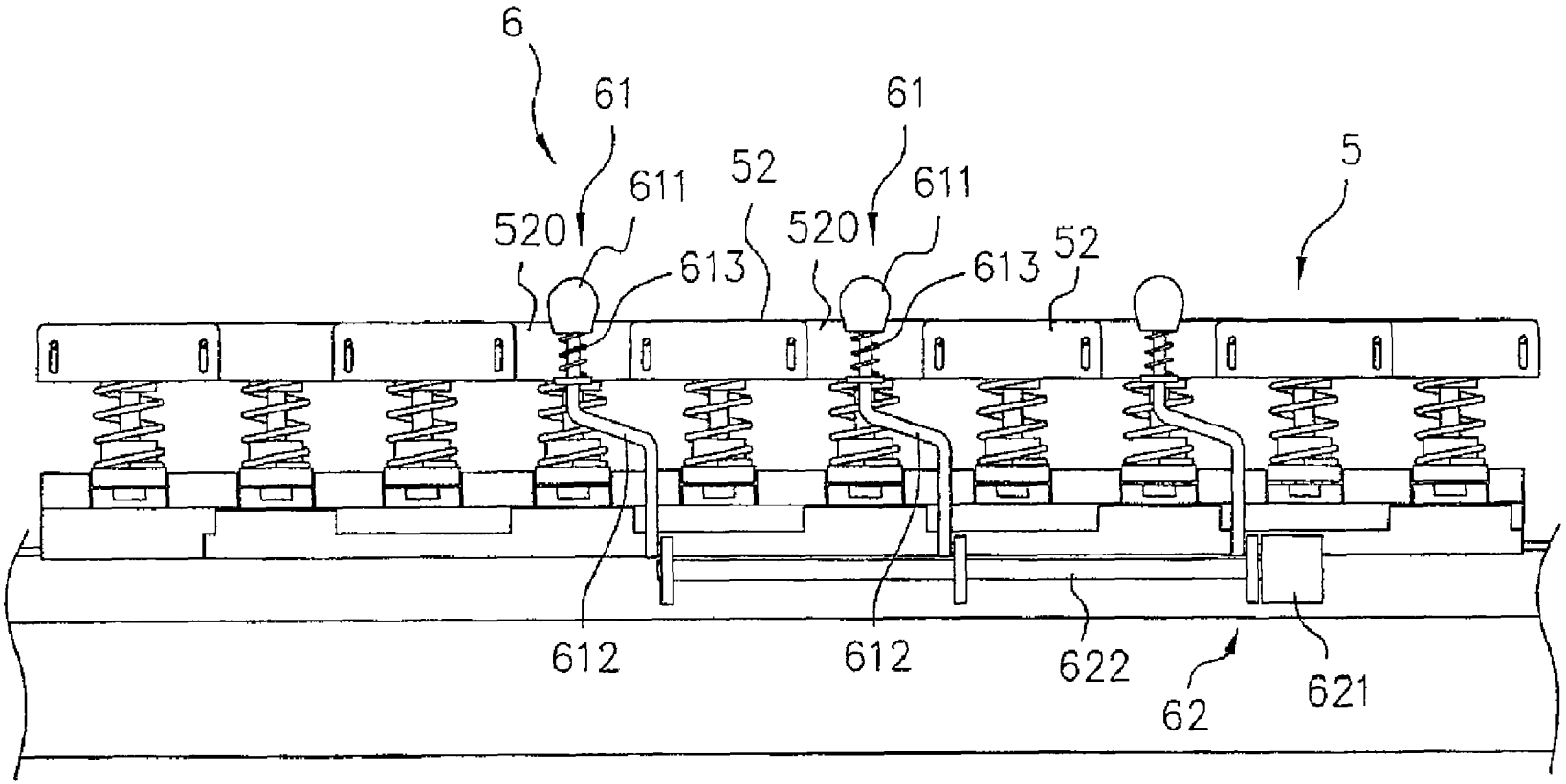
FIG. 15 is a schematic operational view, which, together with FIG. 14, demonstrate the operation of the flapping unit.

As shown in FIGS. 14 and 15, the flapping unit 6 comprises a plurality of flappers 61 that are respectively received in the passage channels 520 of the mat body unit 5 and a flapping power unit 62 that drives each flapper 61 to partially project beyond the corresponding passage channel 520. Each flapper 61 is comprised of a flapping head 611 made of a resilient material, a connection rod 612, and a resilient member 613 arranged between the flapping head 611 and the connection rod 612 so that each flapper 61 possesses a resilient effect to avoid damaging a user by over-hitting. In the present embodiment, the flappers 61 are arranged in the passage channels 520 that are located in the area between the first movable bars 411, designating for flapping the back of a user, but can also be arranged at other locations, such as in the passage channels 520 located in an area set between the second, third, or fourth movable bars 412-414 (see FIG. 8) for flapping the body portions of waist, heaps, or legs to meet the needs for different requirements. The locations where the flappers 61 are set can be changed in accordance with the needs of users and are not the sole feature of the present invention and thus not construed as a limitation to the scope of the present invention.

As shown in FIG. 15, the flapping power unit 62 comprises a motor 621 and a transmission member 622 that is driven by the motor 621. Each flapper 61 is fit onto the transmission member 622, whereby when the motor 621 rotates; each flapper 61 is caused to reciprocally move through the passage channel 520 to achieve the result of successively flapping the user. Again, the effect of causing each flapper 61 to project beyond the passage channel 520 can be realized with other ways and any simplified or equivalent variation and modification that are done in accordance with the teaching of this specification are considered within the scope of the present invention.

As shown in FIGS. 8 and 9, the covering unit 7 comprises a ventilation opening 72 that is formed in the covering envelop 71 for the passage of air. With air taken in by the ventilation opening 72 and flowing through the ventilation channels 522 of each mat block 52 (as shown in FIG. 9), dissipation of heat can be realized, so that a long-lying user may not damage his or her skin due to sultriness. Certainly, hot air can be introduced as desired to provide the effectiveness of warm-keeping.

A user, when lying on the health mat 2, may activate various body health enhancing functions. For example, when the massage power unit 42 of the movable bar unit 4 is activated, each movable bar set 41 is reciprocally moved, of which a moving distance can be set to correspond to the length of one mat block 52 or other suitable distance, whereby each cross bar 54 (as shown in FIG. 3) or mat block 52 of the mat body unit 5 is moved to carry out kneading on various parts of the user, such as back, waist, heaps, and legs, to relax the muscles or release sourness and pain.

It should be noted that the massage power unit 42 can be operated in a slow speed in accordance with the needs of a user, making the cross bars 54 (as shown in FIG. 3) or the mat blocks 52 performing switching operation of horizontal displacement in a slow speed; especially when the user is in a sleeping condition, kneading can be continuously applied to the user, without interfering with the sleep of the user, to relax the muscles and make the user feel comfortable.

Meanwhile, due to the displacement of the cross bars 54 (as shown in FIG. 3) or the mat blocks 52, the portions of the user that were previously depressed can get relaxed, effecting switching of the depressed portion and kneading. For users who have to lie on beds for a long time, such a function allows the maintenance of the muscles in an excellent condition, eliminating occurrence of harmful consequences, such as paralysis.

As shown in FIGS. 12 and 13, when the elevation power units 56 of the mat body unit 5 are activated, the cams 562 drive the elevation bars 55 upward, making some of the mat blocks 52 projecting beyond other mat blocks 52, which, together with the operation of the massage power unit 42, causes the mat body unit 5 to reciprocally move, enhancing the effectiveness of kneading.

As shown in FIGS. 14 and 15, when the flapping power unit 62 of the flapping unit 6 is activated, each flapper 61 is caused to project beyond each mat block 52 to carry out an operation of flapping the back of the user. Especially when the respiratory passage of the user has sputum deposited therein, such a function of the flappers 61 can help expectoration of the sputum.

Thus, by means of the movements of the components of the health mat 2, especially the switching operation realized by the horizontal reciprocal displacement of the mat body unit 5, the skin and muscle of a user lying on the health mat 2 can be completely massaged or kneaded, thereby enhancing blood circulation of the user, maintaining good conditions of the muscles, and eliminating the occurrence of harmful consequences, such as paralysis.

Embodiment 3

Figure 16:
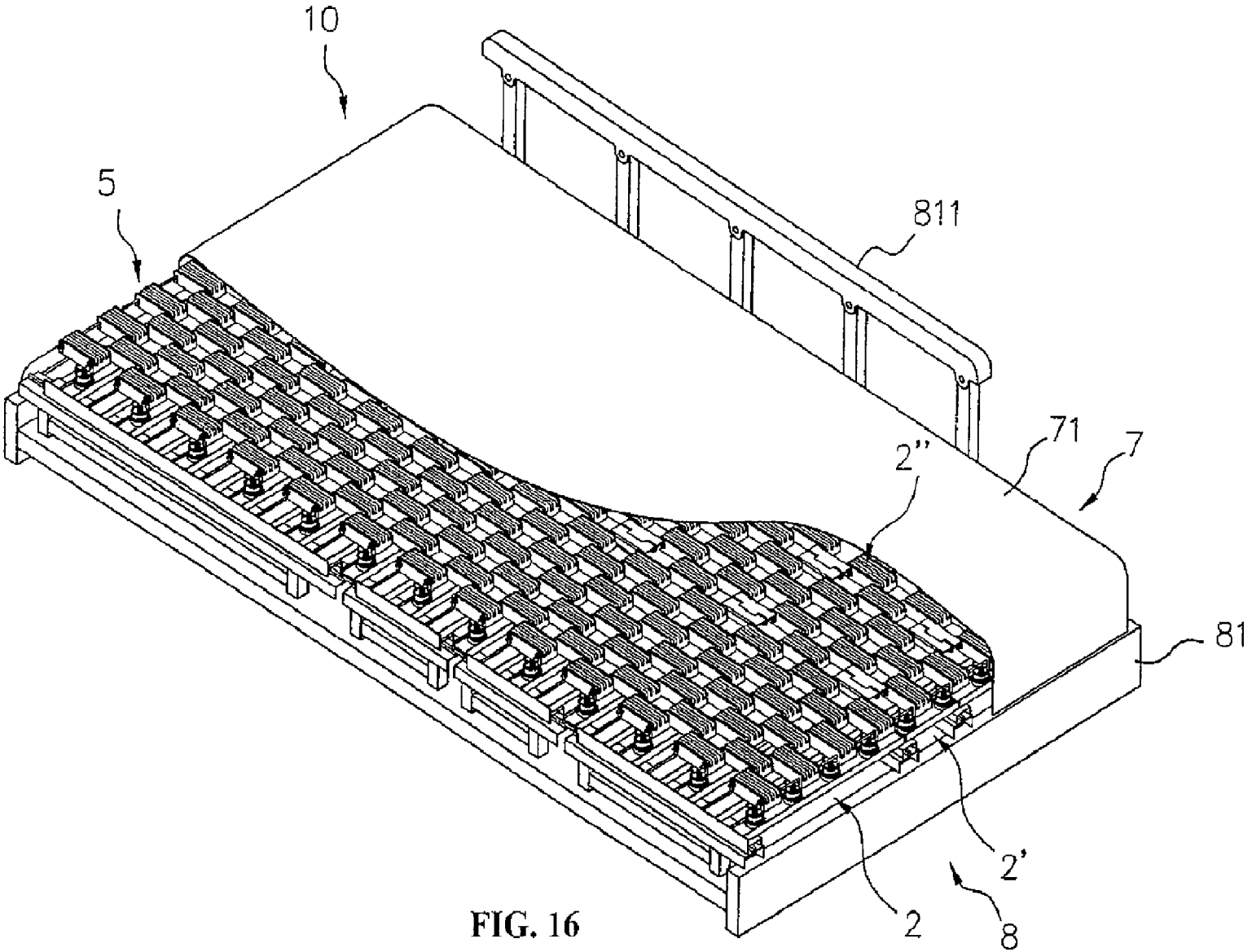
FIG. 16 is a perspective view, illustrating major components of a third embodiment of the present invention and relative positions thereof.
Figure 17:
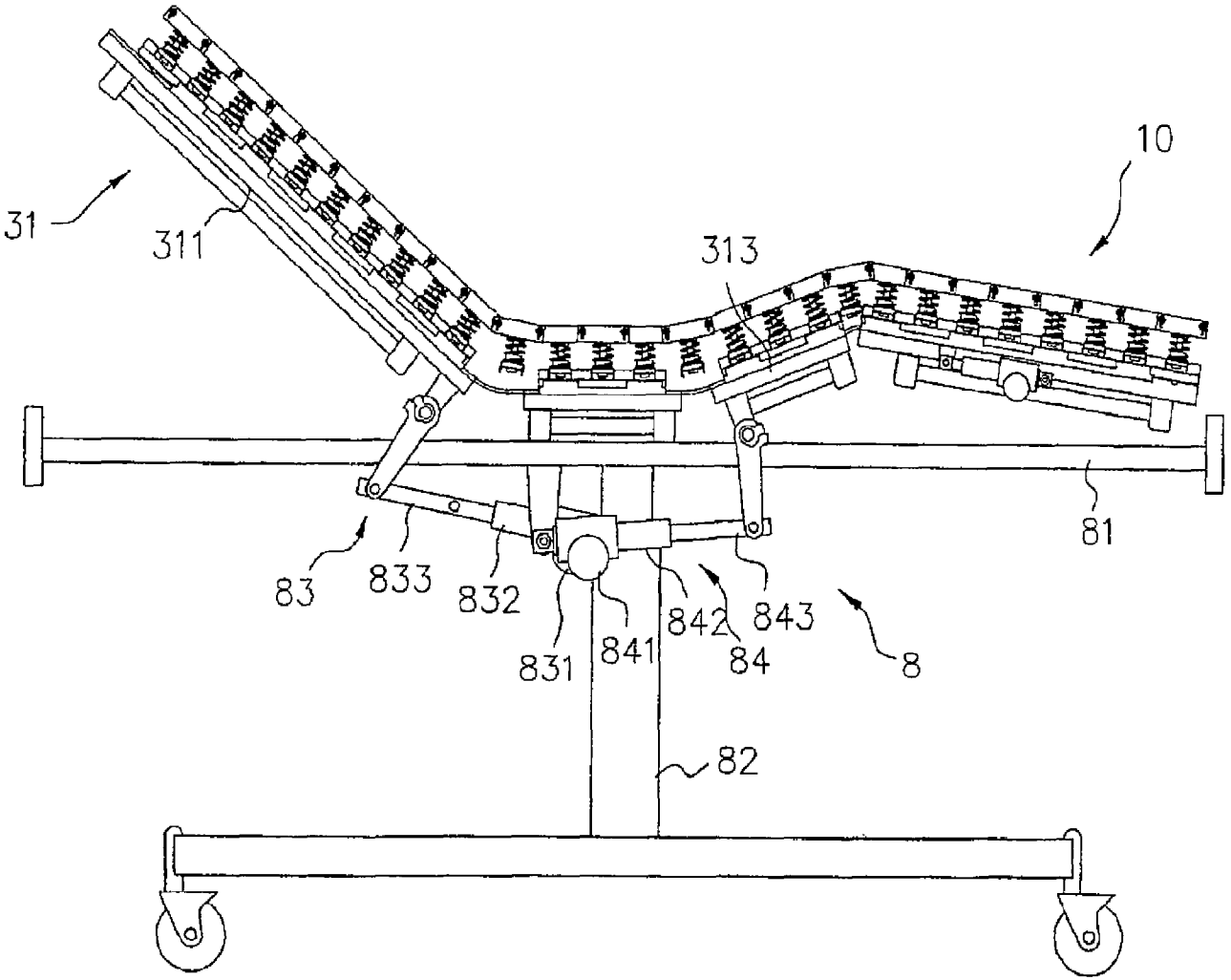
FIG. 17 is a side elevational view, illustrating a user set in a semi-sitting condition by the operation of front and rear lifting power units of a health bed, in which the covering unit is removed.

As shown in FIGS. 16 and 17, a health bed 10 in accordance with a preferred embodiment of the present invention is shown, wherein the health mat 2 that was described in the previous embodiments can be positioned on a bed frame to form a complete bed. The health bed 10 comprises a bed frame unit 8 and three health mats 2, 2', 2". The health mats 2, 2', 2" are positioned on the bed frame unit 8 in an juxtaposed manner and adjacent ones of the health mats 2, 2', 2" are pivotally coupled to each other.

The constituent components of the health mats 2, 2', 2" and the functions that they can realize have already been disclosed in the previous embodiments and are thus not described here in the present embodiment. By cooperating with the bed frame unit 8, the health bed 10 can provide more functions to help users or to assist the care service providers to take care of the users, and an illustration will be given below.

Figure 21:
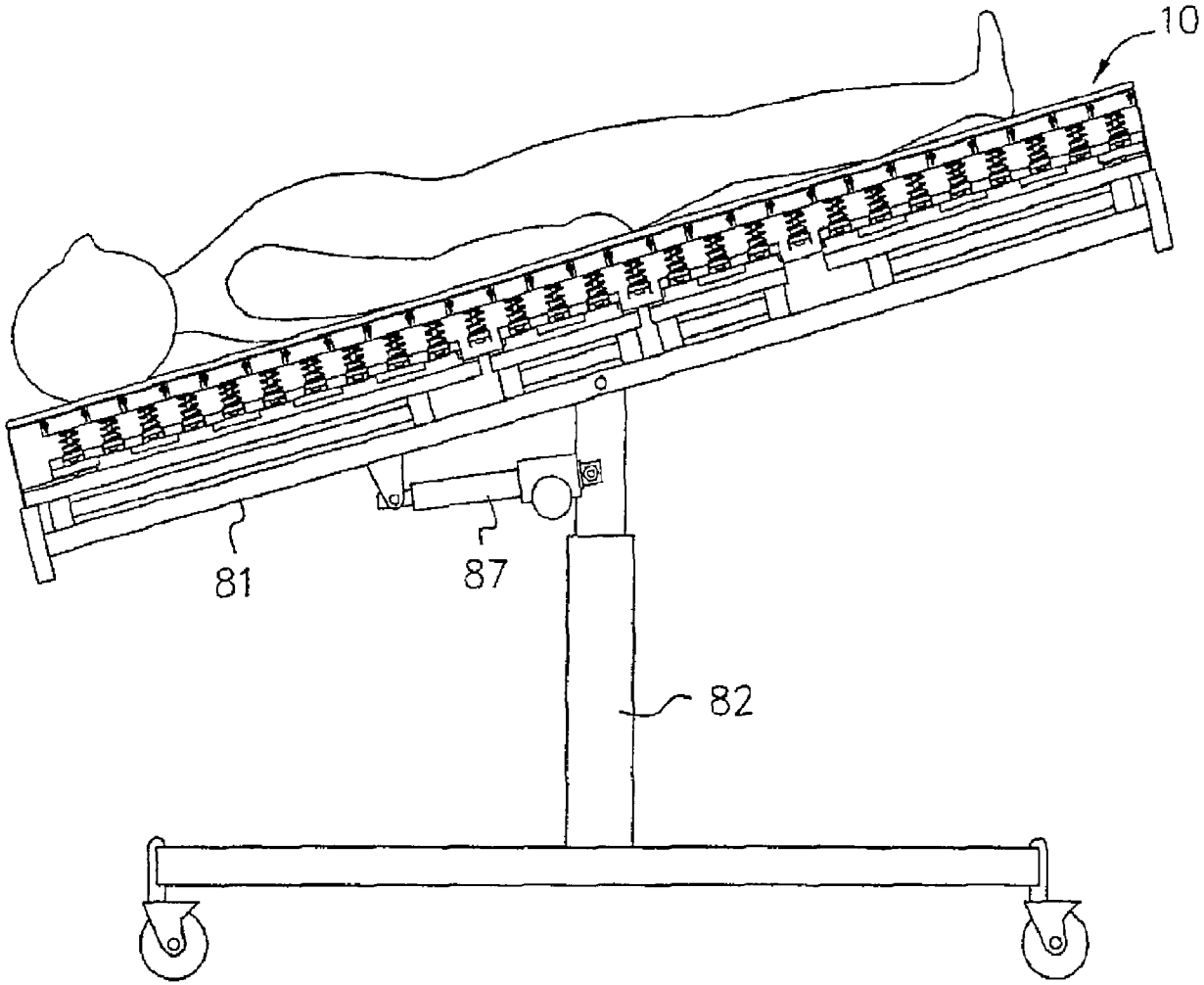
FIG. 21 is a side elevational view, illustrating the health bed set in a head-lowered and leg-raised condition.

As shown in FIG. 17, the bed frame unit 8 comprises a bed frame 81, a lifting member 82 for supporting and lifting the bed frame 81, front and rear lifting power units 83, 84 and left and right lifting power units 85, 86 (see FIG. 19) that are respectively mounted to the bed frame 81, and a side lifting power unit 87 (see FIG. 21).

As shown in FIG. 16, the bed frame 81 comprises two handrail sets 811 (only one being shown in the drawing), which are arranged on and are foldable for being laid flush with the opposite sides thereof, for the purposes of being held by and supporting a user and preventing the user from falling down from the bed.

The lifting member 82 functions to raise or lower the bed frame 81 in a horizontal condition for adjusting an altitude that is suitable for the user to get on/off the bed and for the family member to take care of the user. In the present embodiment, the lifting member 82 is operated electrically, but manual operation can also be adopted.

As shown in FIG. 17, the front lifting power unit 83 functions to have the first fixed bar 311 of the fixed bar set 31 lifting upward, setting the upper half portion of the body in an inclined condition for resting, reading, or assisting a care service provider to feed a user. The rear lifting power unit 84 functions to have the third fixed bar 313 of the fixed bar set 31 lifting upward to bend the legs of the user, and may cooperate with the front lifting power unit 83 to set the upper half portion of the body of the user in a semi-sitting posture. In the present invention, the front and rear lifting power units 83, 84 are each comprised of a motor 831, 841, a gear train 832, 842 that is driven by the motor 831, 841, and an extension/contraction member 833, 843 that is driven by the gear train 832, 842 to extend or contract. However, the upward lifting of the first and third fixed bar 311, 313 of the fixed bar set 31 can be instead carried out by a hydraulic cylinder and associated component. In each use of the health bed 10, since the operation of the front and rear lifting power units 83, 84 is not frequent, the operation can be done manually to achieve the above purposes. However, the driving device and the way of driving in this respect are not an important feature of the present invention and are known to those skilled in the art, and thus constitute no constraint to the present invention.

Figure 18:
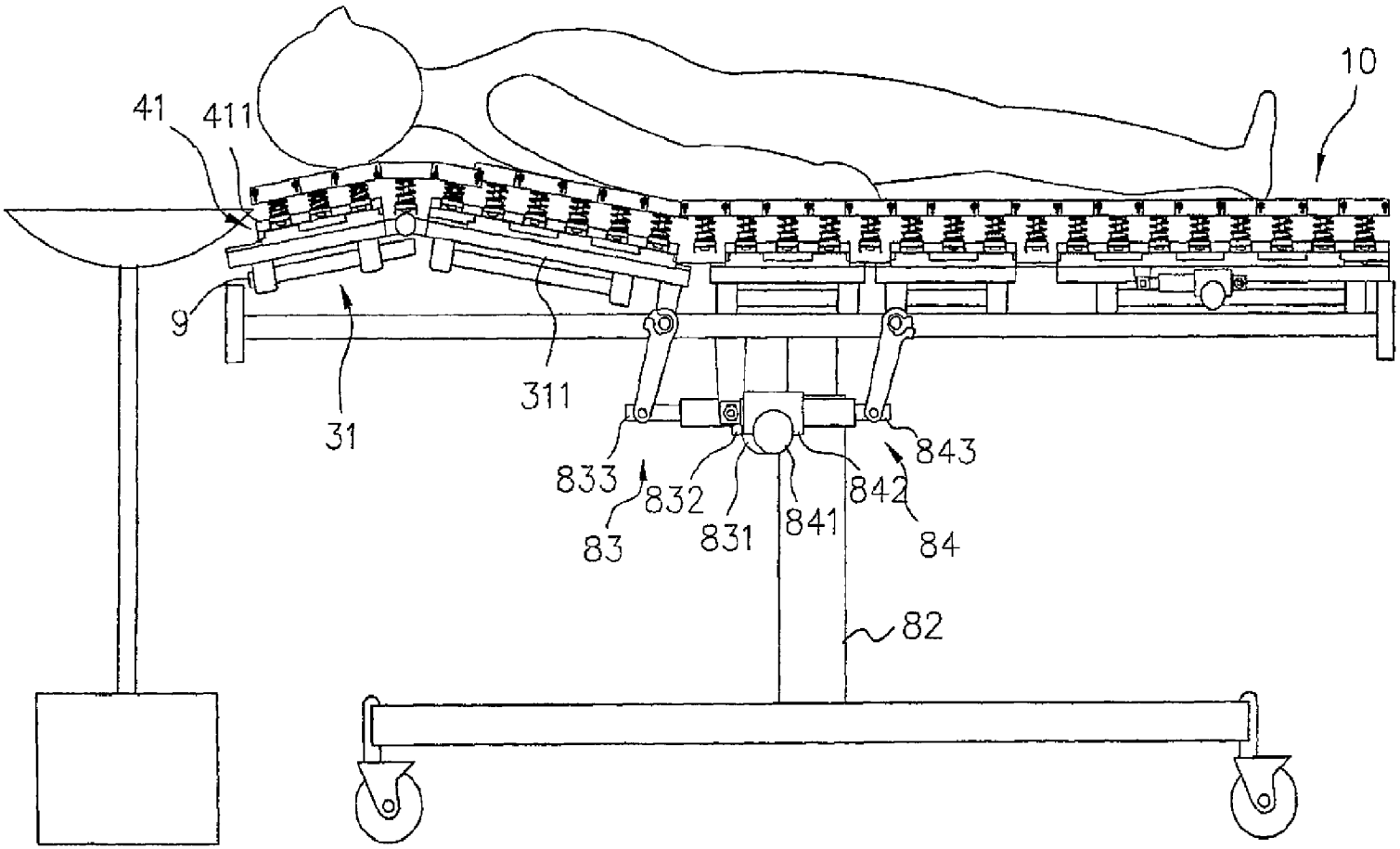
FIG. 18 is a side elevational view, illustrating a condition where the health bed is used to allow a user to wash hairs.

As shown in FIG. 18, the health bed 10 is also helpful to a user for washing hairs. The first fixed bars 311 of the fixed bar sets 31 and the first movable bars 411 of the movable bar sets 41 (only one being shown for both) are of a curved configuration so that when a user lying flat and facing upward, the head inclines downward to facilitate washing of the hairs. In the present invention, a support bar 9 that is movably arranged on the underside of the first fixed bar 311 is used to determine if the first fixed bar 311 and the first movable bar 411 are in the curved configuration. In other words, when the front lifting power unit 83 causes the first fixed bar 311 to rotate upward to a suitable angle, in case that a user needs to have the hairs washed, the support bar 9 is pulled to detach to allow the first fixed bar 311 and the first movable bar 411 to be bent by gravity thereof, allowing the user's head to incline downward for washing hairs, whereby there is no need to spend a lot of effort to lift and move the user. When there is no intention to use the function of hair washing, the support bar 9 is fit in to support the first fixed bar 311 and the first movable 411 in a horizontal condition.

Figure 19:
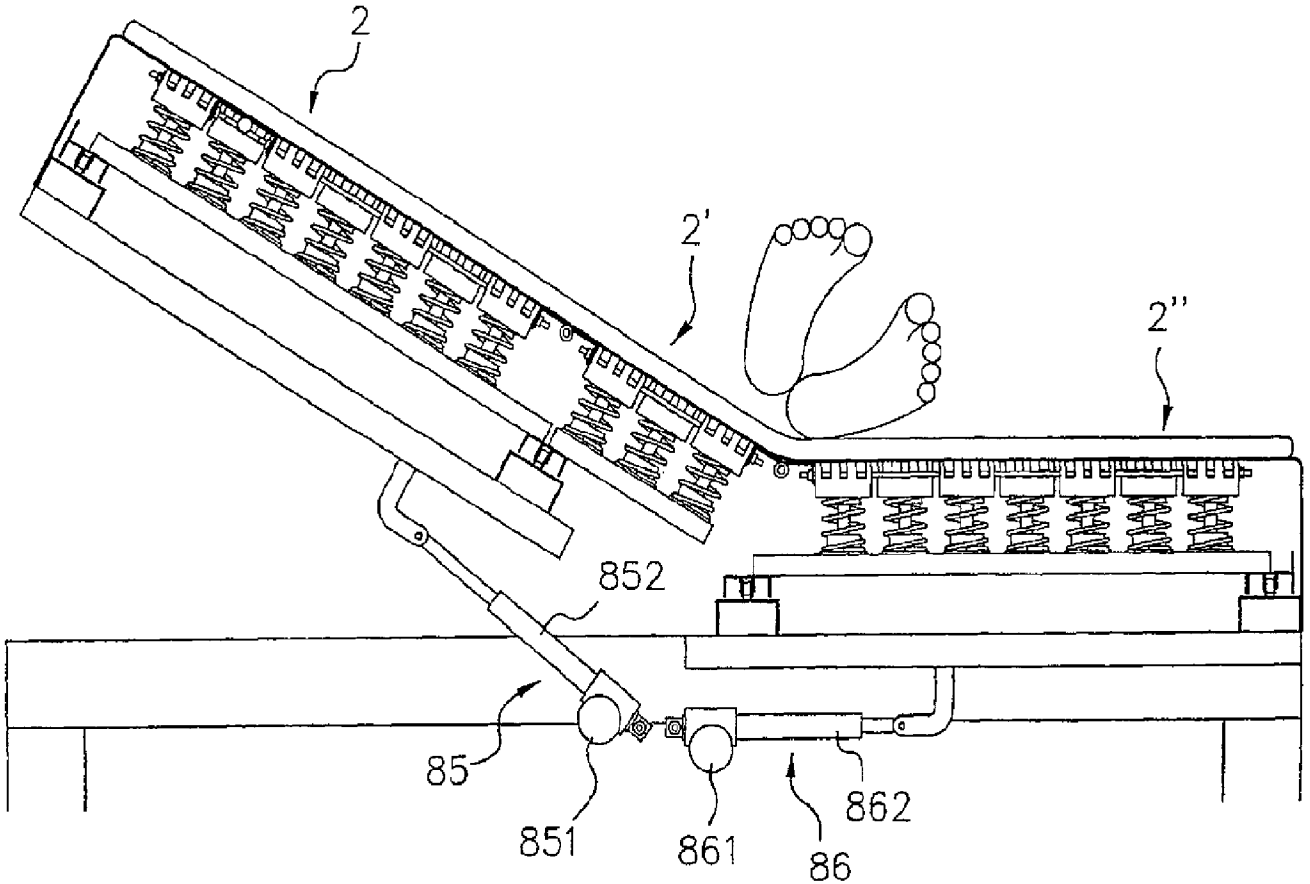
FIG. 19 is a side elevational view, illustrating a condition where the health bed allows the user to turn his body rightward.
Figure 20:
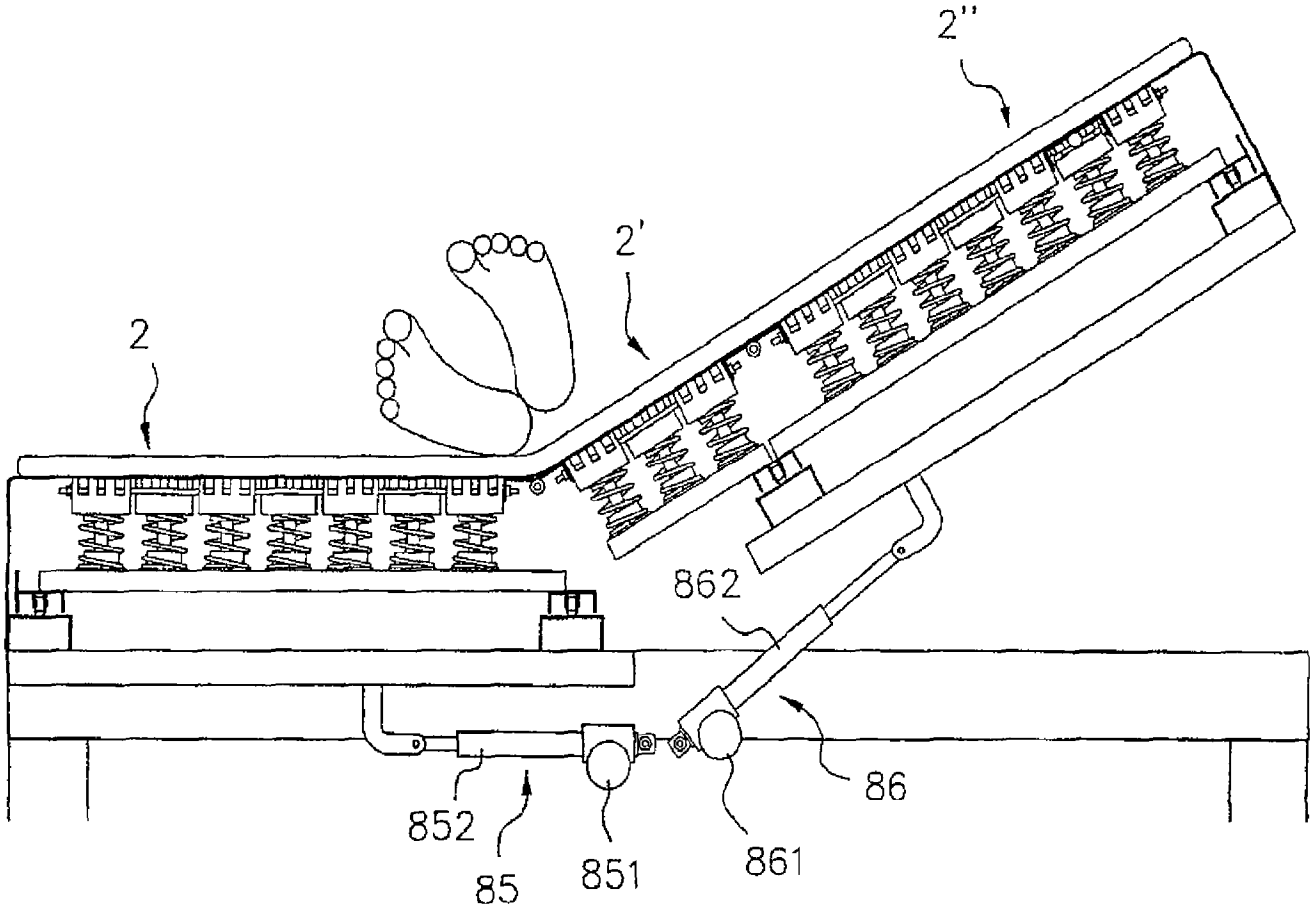
FIG. 20 is a side elevational view, illustrating a condition where the health bed allows the user to turn his body leftward.

As shown in FIGS. 19 and 20, the left lifting power unit drives the adjacent health mats 2, 2' to allow a user to take a right turn of his or her body for preventing a single side of the user from being depressed for an over-elongated period of time and also for helping a care service provider to carry out operations such as back washing and clothe changing. In the present embodiment, the left and right lifting power units 85, 86 are each comprised of a motor 851, 861 and an extension/contraction member 852, 862 that is driven by the motor 851, 861 to extend or contract. However, it is apparent that the upward lifting of the health mats 2, 2', 2" can be instead achieved by a hydraulic cylinder and associated component. Certainly, the same purpose can be realized manually. However, the driving device and the way of driving in this respect are not the sole feature of the present invention and are known to those skilled in the art, and thus constitute no constraint to the present invention.

Figure 22:
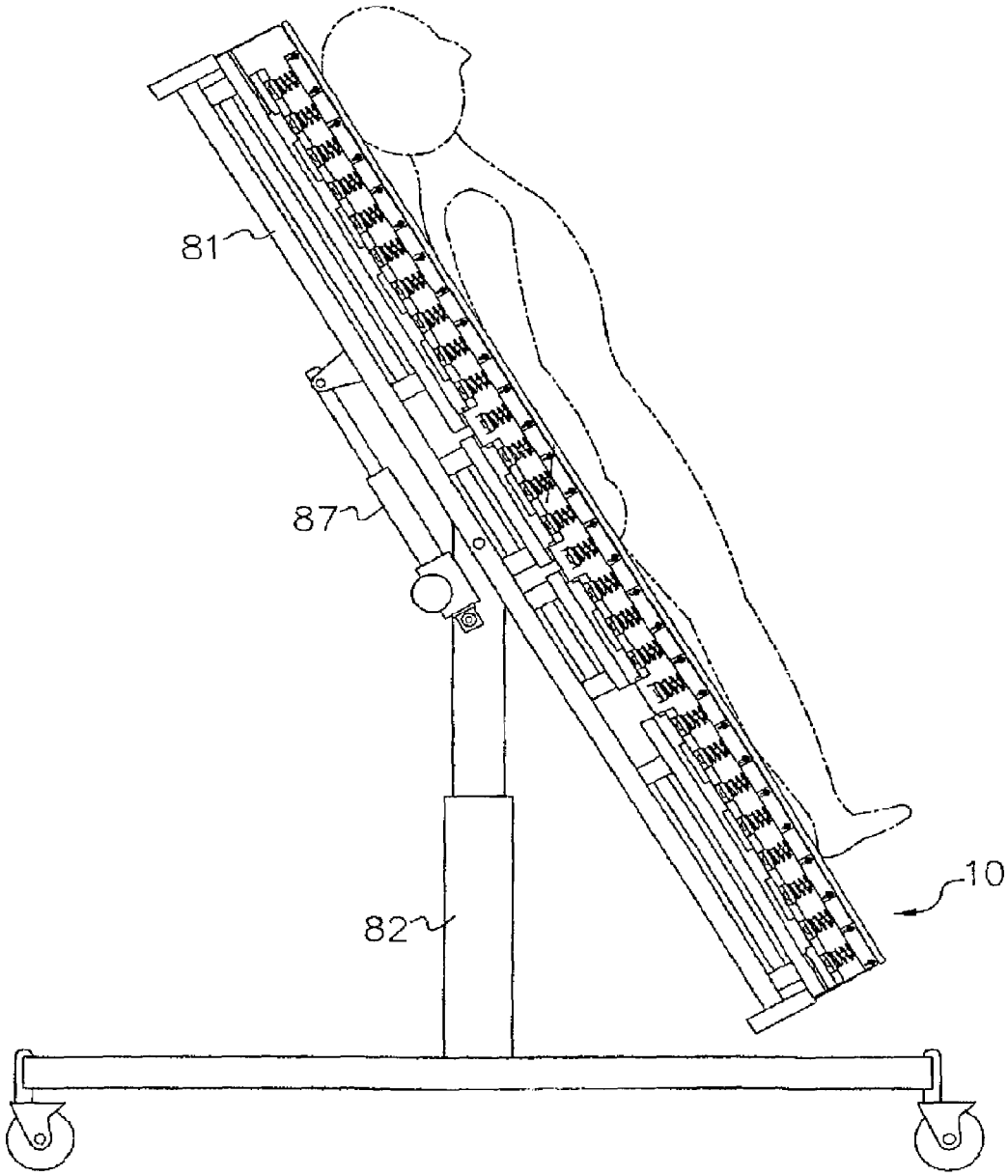
FIG. 22 is a side elevational view, illustrating the health bed set in a head-raised and leg-lowered condition.

As shown in FIGS. 21 and 22, the side lifting power unit 87 is mounted to the lifting member 82 and functions to cause the bed frame 81 to incline forwardly or backwardly, setting the user in a posture of being either head raised and legs lowered or legs raised and head lowered to change the condition of blood circulation and also to enhance the circulation function of healthy people, or to facilitate the performance of therapeutic treatment for the user. For example, in a practical application of medical treatments, a treatment process for the so-called "Octoconia Dislodgment Syndrome" can be carried out by using the side lifting function of the side lifting power unit 87. Since the cause for the disease to occur in a patient is the dislodgment of octoconia inside the utriculus of the inner ear, which induces vertigo of the patient. By using the side lifting power unit 87, the patent can be set in a head-lowered and leg-raised posture, which facilitate a medicine doctor to perform particle repositioning maneuver.

Since the health bed 10 features various functions, to avoid incorrect operation by an operator that causes damage of the components, a control unit (not shown) that is electrically connected to every power unit can be provided to respectively control the operation of the power unit. For example, when the front and rear lifting power units 83, 84 (see FIG. 17) are being in operation, the left and right lifting power units 85, 86 (see FIG. 19) or the side lifting power unit 87 is disabled from operation. Certainly, advanced protection can be added by providing a plurality of limit switches around each power unit to ensure operation safety of the health bed 10.

As shown in FIG. 16, together with reference made to FIG. 8, it is noted from the above description that the health bed 10 that is comprised of three health mats 2, 2', 2" surely possesses the following technical effectiveness:

(1) Effectively maintaining excellent condition of skin and avoiding the occurrence of harmful consequence such as paralysis: The mat body unit 5 of the health mat 2 can take reciprocal movement by means of the massage power unit 42 of the movable bar unit movable bar unit 4 to carry out overall horizontal displacement and switching, whereby the back of a user can be subjected to all-round and successive kneading, rather than pressing at selected locations with limited frequency that occurs in the publicly-known techniques, and thus the occurrence of harmful consequence to the skin can be effectively eliminated.

Figure 2:
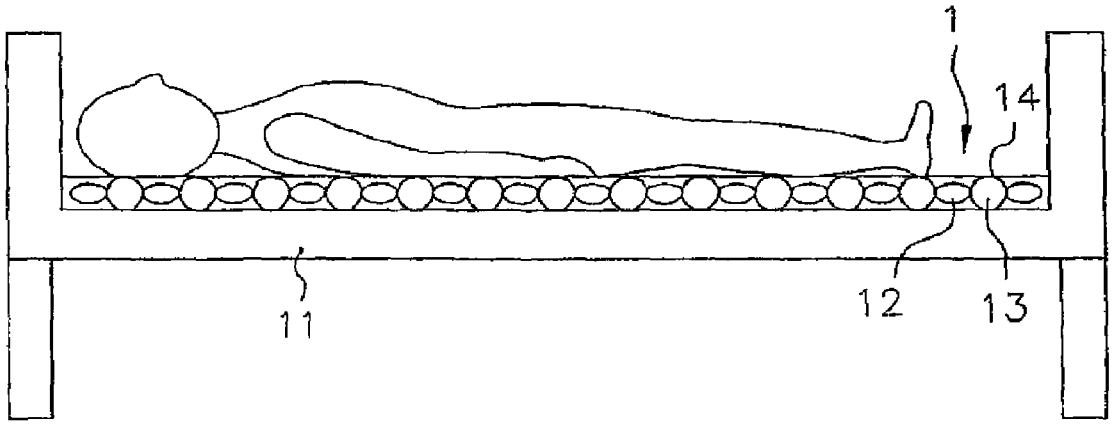
FIG. 2 is a cross-sectional view illustrating another situation, which together with FIG. 1 demonstrates the operation relationship among the various components of the known health mat.

(2) Possessing various functions of health care and assistance of performance of care service: As mentioned above, with the arrangement of the various components of the health mat 2 and the functions realized thereby, besides the health care effect of all-round kneading that the user may enjoy, the elevation bars 55 of the mat body unit 5 (see FIG. 2) and the flapping unit 6 are provided for enhancing the result of kneading and performing a back flapping function, to thereby help smoothening flow of blood circulation of the user and expectoration of sputum; further, with the arrangement of the front and rear lifting power units 83, 84 (see FIG. 17) of the bed frame unit 8, the user is allowed to set in a semi-sitting posture; with the arrangement of the left and right lifting power units 85, 86 (see FIG. 19) of the bed frame unit 8, over-turning of the body of the user can be facilitated; with the arrangement of the side lifting power unit 87 (see FIG. 21) of the bed frame unit 8, the user can be made head lowered and legs raised to effect change of blood circulation condition or to help the performance of therapeutic treatment.

(3) Having wide applications: As mentioned above, due the various functions provided by the health mat 2, plus the symptoms of waist sourness and back pain that often occur in the modern people, besides for use by regular people, the health mat 2 or the health bed 10 is also suitable for the aged or those long lying on sick bed and is thus of a great market demands and commercial opportunity.

(4) Being of low costs: Since the health mat 2 and the health bed 10 possess various functions, for those needing to use the health mat 2 and the health bed 10, such as individual users, sanatoriums, or hospitals, the costs for installing other related facility or equipments can be saved and additional space can be available for other uses; further, tedious jobs, such as flapping back, massage, kneading, and turning body can be carried out by the health bed 10, allowing reduction of work load for the care service provider. Thus, this not only saves the labor costs for the users, but is also good for the health of the care receivers or the patient, and thus all kinds of costs are reduced and more profit are gained with increased market competition power.

Conclusively, the health mat 2 in accordance with the present invention can be used independently and can be positioned at any location where kneading or massage is desired, such as on a chair frame or a bed frame, in order to immediately carry out the kneading operation for muscle relaxation and this is very convenient. On the other hand, by combining the health mat 2 with a bed frame, a health bed 10 featuring health caring and therapeutic treatment is provided with extraordinary applications.

As shown in FIGS. 3, 6, 8, and 16, the health mat 2 and the health bed 10 realize an integration of the depression location switching theory of the western medicine and the kneading theory of the Chinese medicine. With the massage power unit 42 of the movable bar unit 4, the cross bars 54 (see Figure movable bar unit 4) or the mat blocks 52 of the mat body unit 5 are reciprocally movable to switch the locations of depression, enhancing blood circulation and avoiding the occurrence of harmful consequence of the skin; or is operable in a slow manner to smoothen the blood circulation of a user without causing interference to his or her sleep; use the elevation bars 55 and the elevation power units 56 to have some cross bars 54 (see Figure movable bar unit 4) or mat blocks 52 to project outward for enhanced kneading effect; use the flapping unit 6 to carry out back flapping operation for helping expectoration of the sputum; adopt three health mats 2, 2', 2" that are pivotally coupled to each other and positioned on the bed frame 81, plus the front, rear, left, and right lifting power units 83-86 (see FIGS. 17 and 19) and the side lifting power unit 87 (see FIG. 21), to form a health bed 10 that helps a user to perform the operations of raising the upper body portion, raising the legs, and turning body over, or a health bed 10 for therapeutic treatment purposes. All these functions are not only good for health care for healthy people but also provide complete assistance to those long lying on bed, such as the aged or the paralyzed patients, helping cut down the number of attending people and the work load thereof.

With the above description of the preferred embodiments of the present invention, it is apparent to those skilled in the art that the above described embodiments are not construed to limit the present invention and equivalent variations and modifications that are mode on the basis of the essences and the contents of description given above are considered within the scope of the present invention.

What is claimed is:

1. A health mat adapted to be positioned on a support rack, characterized by comprising:

a fixed bar unit comprising two fixed bar sets, which are arranged in a spaced manner and are positionable on the support rack;

a movable bar unit arranged on the fixed bar unit and comprising two movable bar sets respectively corresponding to the fixed bar sets and a massage power unit that moves the movable bar sets to have each movable bar set movable with respect to each fixed bar set; and a mat body unit arranged between the movable bar sets and movable in unison therewith, the mat body unit comprising a plurality of cross bars that are of a spaced and parallel arrangement;

wherein each fixed bar set of the fixed bar unit comprises a first fixed bar, a second fixed bar, a third fixed bar, and a fourth fixed bar that are sequentially arranged in a spaced manner and resilient plates or multiple-articulation pivotal connection or single-articulation pivotal connection connected between adjacent ones of the fixed bars, each movable bar set of the movable bar unit comprising a first movable bar, a second movable bar, a third movable bar, and a fourth movable bar, which are arranged in a spaced manner, the first, second, third, and fourth movable bars being each provided with a plurality of rollers.

2. The health mat as claimed in claim 1, characterized in that the cross bars of the mat body unit are of a circular cross-section and the mat body unit further comprises a plurality of rotary tubes that are rotatable, each cross bar being fit with at least one of the rotary tubes.

3. The health mat as claimed in claim 1, characterized in that the cross bars are fit through the movable bar sets of the movable bar unit in an upward and downward movable manner, the mat body unit further comprising a plurality of resilient members disposed at opposite ends of each cross bar for biasing each cross bar in an up and down direction, thereby automatically adjusting an altitude of each cross bar.

4. The health mat as claimed in claim 1, characterized in that the mat body unit further comprises an elevation bar that is arranged below a bottom of each cross bar and an elevation power unit that moves the elevation bar, the elevation bar forming in a top face thereof a plurality of recesses that is alternately corresponding to and receiving the cross bars.

5. The health mat as claimed in claim 1, characterized in that the mat body unit further comprises a plurality of mat blocks that are arranged in a spaced manner and are alternate with respect to each other.

6. The health mat as claimed in claim 5, characterized in that the mat body unit further comprises a plurality of resilient members arranged between each mat block and each cross bar and a plurality of interconnection bars that are arranged in a spaced manner and interconnect each mat block, each mat block forming slots which are vertically elongated for an extension of each interconnection bar so as to allow each mat block to be independently movable upward and downward.

7. The health mat as claimed in claim 6, characterized in that the mat body unit further comprises an elevation bar that is arranged below bottom of each cross bar and is movable therewith and an elevation power unit that moves the elevation bar, the elevation bar forming in a top face thereof a plurality of recesses for receiving the cross bars, each recess corresponding to the cross bars that are fixed to the movable bar set and the elevation power unit raising the elevation bar upward to have the cross bars that are not fixed to the movable bar sets moved upward, thus causing some of the mat blocks to project beyond other mat blocks.

8. The health mat as claimed in claim 1, characterized by further comprising a covering unit that covers the mat body unit, the covering unit comprising a covering envelop that is made of a soft material.

9. The health mat as claimed in claim 8, characterized in that the covering unit located on the mat body unit forms a ventilation opening for the passage of air, air being introduced through the ventilation opening to flow through the mat body unit.

10. A health bed, characterized by comprising:

a bed frame unit comprising a bed frame;

plurality of health mats according to claim 1 positioned on the bed frame in a juxtaposed manner, adjacent ones of the health mats being pivotally coupled to each other;

a left lifting power unit and a right lifting power unit arranged below the plurality of health mats, whereby when the left lifting power unit is in operation, two of the health mats on a left side are turned rightward and when the right lifting power unit is in operation, two of the health mats on a right side are turned leftward.

11. The health bed as claimed in claim 10, characterized in that the mat body unit further comprises an elevation bar that is arranged below bottom of each cross bar and is movable therewith and an elevation power unit that moves the elevation bar, the elevation power unit raising the elevation bar upward to have the cross bars that are not fixed to the movable bar sets moved upward, thus causing the cross bars to alternately project outward.

12. The health bed as claimed in claim 10, characterized in that the mat body unit further comprises a plurality of mat blocks that is arranged in a spaced manner and is arranged on each cross bar, an elevation bar that is arranged below bottom of each cross bar and is movable therewith and an elevation power unit that moves the elevation bar, the elevation power unit raising the elevation bar upward to have alternate ones of the cross bars moved upward, thus causing the mat blocks corresponding to said cross bars to project beyond other mat blocks.

13. The health bed as claimed in claim 10, characterized in that the bed frame unit further comprise a lifting member for supporting and lifting the bed frame.

14. The health bed as claimed in claim 13, characterized in that the bed frame unit further comprises a side lifting power unit that is mounted to the lifting member and functions to incline the bed frame.

15. The health bed as claimed in claim 10, characterized in that the bed frame unit further comprises a front lifting power unit and a rear lifting power unit that are mounted to the bed frame, the front lifting power unit and the rear lifting power unit being respectively for lifting a first fixed bars and a third fixed bars of the fixed bar sets upward.

16. The health bed as claimed in claim 10, characterized in that the bed frame comprises two foldable handrail sets.

17. The health bed as claimed in claim 10, characterized by further comprising a covering unit that covers the mat body unit, the covering unit comprising a covering envelop that is made of a soft material.

18. The health bed as claimed in claim 17, characterized in that the covering unit located on the mat body unit has a ventilation opening for the passage of air, air being introduced through the ventilation opening to flow through the mat body unit.

* * * * *